US008663023B2

(12) United States Patent
Henry et al.

(10) Patent No.: US 8,663,023 B2
(45) Date of Patent: Mar. 4, 2014

(54) METHODS AND SYSTEMS FOR VIEWING MARINE LIFE FROM SELF-CONTAINED FLOATING MARINE PARKS

(75) Inventors: Jeffery Wayne Henry, New Braunfels, TX (US); John Timothy Schooley, New Braunfels, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 508 days.

(21) Appl. No.: 12/941,215

(22) Filed: Nov. 8, 2010

(65) Prior Publication Data

US 2011/0118039 A1 May 19, 2011

Related U.S. Application Data

(63) Continuation of application No. 11/513,314, filed on Aug. 30, 2006, now Pat. No. 7,828,667.

(60) Provisional application No. 60/713,847, filed on Sep. 2, 2005.

(51) Int. Cl.
*A63G 31/00* (2006.01)
*A63G 21/18* (2006.01)

(52) U.S. Cl.
USPC ..... 472/128; 472/129

(58) Field of Classification Search
USPC ..... 472/13, 117, 128, 129; 114/61, 66, 270
See application file for complete search history.

(56) References Cited

U.S. PATENT DOCUMENTS

| | | | |
|---|---|---|---|
| 193,516 | A | 7/1877 | Johns |
| 419,860 | A | 1/1890 | Libbey |
| 435,227 | A | 8/1890 | Inglis |
| 485,624 | A | 11/1892 | Gardner |

(Continued)

FOREIGN PATENT DOCUMENTS

| | | |
|---|---|---|
| BE | 543055 | 12/1955 |
| DE | 893778 | 10/1953 |

(Continued)

OTHER PUBLICATIONS

AA51—International Search Report and Written Opinion for PCT/US06/15503 mailed Jul. 6, 2007.

(Continued)

*Primary Examiner* — Kien Nguyen
(74) *Attorney, Agent, or Firm* — Meyertons, Hood, Kivlin, Kowert & Goetzel, P.C.; Eric B. Meyertons

(57) ABSTRACT

A water transportation system and method are described, generally related to water amusement attractions and rides. This transportation system comprises at least two water stations and at least one water channel connecting the at least two water stations for the purpose of conveying participants between the at least two water stations. In addition, a floating water park positioned in a body of water is described, as well as, a floating marine park. A floating marine/water park may include one or more floating containers positioned in a body of a first fluid. One or more of the floating containers may function to hold a second fluid, marine life, and/or participants in water amusement activities. A floating container may include a view window configured to allow participants (e.g., below the surface of water) in a first floating container to view marine life or participants in a second floating container.

19 Claims, 12 Drawing Sheets

(56) References Cited

U.S. PATENT DOCUMENTS 536,441 A 3/1895 Morris
540,715 A 6/1895 Butler
548,256 A 10/1895 Idler
552,713 A 1/1896 Lenox
555,049 A 2/1896 Ogilbe
566,182 A 8/1896 Jackman
570,016 A 10/1896 Harman
572,426 A 12/1896 Idler
576,704 A 2/1897 Urch
583,121 A 5/1897 Pattee
604,164 A 5/1898 Wilde et al.
610,548 A 9/1898 Manny
640,439 A 1/1900 Boyton
654,980 A 7/1900 Howard
664,179 A 12/1900 Schofield
665,765 A 1/1901 Thompson
689,114 A 12/1901 Pape
691,353 A 1/1902 Carpenter et al.
697,202 A 4/1902 Donne
697,891 A 4/1902 Schrader
714,717 A 12/1902 LaPorte
720,014 A 2/1903 Folks
724,040 A 3/1903 Pusterla
724,757 A 4/1903 Symonds
728,303 A 5/1903 Roltair
728,894 A 5/1903 Folks
741,964 A 10/1903 Harlan
743,968 A 11/1903 Wilson
744,880 A 11/1903 Smith
753,311 A 3/1904 Pusterla
753,449 A 3/1904 Thompson
754,698 A 3/1904 Reed
757,286 A 4/1904 Du Clos
760,503 A 5/1904 Welsh
762,566 A 6/1904 Webster et al.
764,675 A 7/1904 Pfeiffer
774,209 A 11/1904 Stubbs
774,274 A 11/1904 Pusterla
774,917 A 11/1904 Maguire
776,936 A 12/1904 Pusterla
779,464 A 1/1905 Bruce
783,425 A 2/1905 Folks
792,422 A 6/1905 Kelly
801,945 A 10/1905 Welsh
808,487 A 12/1905 Stahl
824,436 A 6/1906 Pester
828,689 A 8/1906 Thompson
831,149 A 9/1906 Faller
849,970 A 4/1907 Boyton
868,736 A 10/1907 Washington
869,432 A 10/1907 Gin
879,283 A 2/1908 Mayberry et al.
883,441 A 3/1908 Andrews
891,388 A 6/1908 Visser et al.
896,940 A 8/1908 Rosen
904,848 A 11/1908 DeVore
929,972 A 8/1909 M'Giehan
931,863 A 8/1909 Haight
952,673 A 3/1910 Karr
1,004,174 A 9/1911 Kavakos
1,056,929 A 3/1913 Navarro
1,062,838 A 5/1913 Miller
1,063,949 A 6/1913 Bedient
1,095,965 A 5/1914 Glazier
1,124,950 A 1/1915 Reagen et al.
1,158,295 A 10/1915 Rodriguez
1,159,519 A 11/1915 Menier
1,167,993 A 1/1916 Guzendorfer
1,195,707 A 8/1916 Miller
1,198,749 A 9/1916 Myers
1,230,559 A 6/1917 Burke
1,249,455 A 12/1917 Myers
1,320,124 A 10/1919 Chrul
1,378,635 A 5/1921 Unger
1,399,469 A 12/1921 Cucullu
1,417,570 A 5/1922 Ridgway
1,440,661 A 1/1923 Dickinson
1,441,126 A 1/1923 Sherman et al.
1,448,306 A 3/1923 Lezert
1,497,754 A 6/1924 Howard
1,520,217 A 12/1924 Auperl
1,540,635 A 6/1925 Kohl
1,551,249 A 8/1925 Held
1,563,855 A 12/1925 Held
1,591,566 A 6/1926 Schmidt et al.
1,601,483 A 9/1926 Vaszin
1,606,024 A 11/1926 Gorhum et al.
1,606,854 A 11/1926 Vaszin
1,607,771 A 11/1926 Miller
1,609,922 A 12/1926 Wiig
1,648,196 A 11/1927 Rohmer
1,763,976 A 6/1930 Lippincott
1,783,268 A 12/1930 Traver
1,849,226 A 3/1932 Erban
1,859,267 A 5/1932 Kurz
1,893,167 A 1/1933 Glagolin
1,926,780 A 9/1933 Lippincott
2,064,035 A 12/1936 Rynearson
2,146,631 A 2/1939 Kish
2,484,466 A 3/1946 Rumler
2,705,144 A 3/1955 Ridgway
2,738,885 A 3/1956 Demaline
2,794,191 A 6/1957 Gaskouitz
2,888,205 A 5/1959 Trucco
D190,127 S 4/1961 Fowler
2,991,726 A 6/1961 Miller
3,000,017 A 9/1961 Skovira
3,003,430 A 10/1961 Hamel
3,011,280 A 12/1961 Keidd
3,030,895 A 4/1962 Hamel
3,113,528 A 12/1963 Morgan et al.
3,114,333 A 12/1963 Fowler et al.
3,116,925 A 1/1964 Welch
3,240,186 A * 3/1966 Dobell ..... 119/245
D204,282 S 4/1966 Morgan
3,302,413 A 2/1967 Burnett
3,340,635 A 9/1967 McIntosh
3,390,640 A 7/1968 Couttet et al.
3,404,635 A 10/1968 Bacon et al.
3,456,943 A 7/1969 Brown
3,473,334 A 10/1969 Dexter
3,508,405 A 4/1970 Koch
3,534,413 A 10/1970 Plasseraud
3,598,402 A 8/1971 Frenzl
3,690,265 A 9/1972 Horibata
3,730,520 A 5/1973 Willis
D229,354 S 11/1973 Morgan
3,827,387 A 8/1974 Morgan
3,830,161 A 8/1974 Bacon
3,838,648 A 10/1974 Dahlberg et al.
3,853,067 A 12/1974 Bacon
3,861,514 A 1/1975 Ling
3,865,041 A 2/1975 Bacon
3,890,655 A 6/1975 Mathis
3,913,332 A 10/1975 Forsman
3,923,301 A 12/1975 Myers
3,930,450 A 1/1976 Symons
3,956,779 A 5/1976 Jewett
4,001,899 A 1/1977 Mathis
4,063,517 A 12/1977 Nardozzi, Jr.
4,073,722 A 2/1978 Grutsch
4,087,870 A 5/1978 Palmer, Jr.
4,145,770 A 3/1979 Zaris
4,147,635 A 4/1979 Crowe
4,149,469 A 4/1979 Bigler
4,149,710 A 4/1979 Rouchard
4,175,361 A 11/1979 Kumode
4,194,733 A 3/1980 Whitehouse, Jr.
4,196,900 A 4/1980 Becker et al.
4,198,043 A 4/1980 Timbes et al.
4,205,785 A 6/1980 Stanley
4,221,170 A 9/1980 Koudelka
4,225,953 A 9/1980 Simon et al.
4,278,247 A 7/1981 Joppe et al.

(56) References Cited

U.S. PATENT DOCUMENTS 4,299,171 A 11/1981 Larson
4,305,117 A 12/1981 Evans
4,337,704 A 7/1982 Becker et al.
4,376,404 A 3/1983 Haddad
D269,082 S 5/1983 Spieldiener
4,391,201 A 7/1983 Bailey
4,392,434 A 7/1983 Dürwald et al.
4,423,864 A 1/1984 Wiik
4,429,867 A 2/1984 Barber
4,484,739 A 11/1984 Kreinbihl et al.
4,484,836 A 11/1984 Bailard
4,501,434 A 2/1985 Dupuis
4,516,943 A 5/1985 Spieldiener et al.
4,543,886 A 10/1985 Spieldiener et al.
4,545,574 A 10/1985 Sassak
4,545,583 A 10/1985 Pearman et al.
4,558,474 A 12/1985 Bastenhof
4,564,190 A 1/1986 Frenzl
4,576,512 A 3/1986 Combes et al.
4,624,618 A 11/1986 Laberdia et al.
4,683,686 A 8/1987 Ozdemir
4,695,058 A 9/1987 Carter, III et al.
4,696,251 A 9/1987 Spieldiener et al.
4,706,307 A 11/1987 Smith
4,716,854 A 1/1988 Bourdon
4,741,388 A 5/1988 Kuroiwa
4,759,545 A 7/1988 Grable
4,778,430 A 10/1988 Goldfarb et al.
4,783,861 A 11/1988 Leurent
4,792,260 A 12/1988 Sauerbier
4,797,027 A 1/1989 Combes et al.
4,797,605 A 1/1989 Palanisamy
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,876,828 A 10/1989 Brill
4,905,987 A 3/1990 Frenzi
4,910,814 A 3/1990 Weiner
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
4,986,784 A 1/1991 French
5,011,134 A 4/1991 Langford
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,092,268 A 3/1992 Taylor
5,115,908 A 5/1992 Williams
5,137,497 A 8/1992 Dubeta
5,143,107 A 9/1992 Kelley
D330,579 S 10/1992 Briggs
5,152,210 A 10/1992 Chen
5,156,195 A 10/1992 Wehler et al.
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,315,952 A * 5/1994 Jackson, Jr. ..... 114/312
5,320,362 A 6/1994 Bear et al.
5,323,307 A 6/1994 Wolf et al.
5,378,197 A 1/1995 Briggs
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,421,451 A 6/1995 Easton
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,473,233 A 12/1995 Stull et al.
5,478,281 A 12/1995 Forton
5,482,510 A 1/1996 Ishii et al.
5,494,729 A 2/1996 Henry et al.
5,499,821 A 3/1996 Rycroft
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,570,480 A 11/1996 Yeung
5,581,954 A 12/1996 Vollebregt
5,613,443 A 3/1997 Ariga et al.
5,623,986 A 4/1997 Wiggs
5,628,584 A 5/1997 Lochtefeld
5,649,867 A 7/1997 Briggs
5,662,525 A 9/1997 Briggs
5,664,910 A 9/1997 Lochtefeld et al.
5,667,445 A 9/1997 Lochtefeld
5,678,956 A 10/1997 Freelain
5,685,778 A 11/1997 Sheldon et al.
5,704,294 A 1/1998 Van Winkle et al.
5,715,773 A 2/1998 Martelius
5,716,282 A 2/1998 Ring et al.
5,724,768 A 3/1998 Ammann
5,732,635 A 3/1998 McKoy
5,735,748 A 4/1998 Meyers et al.
5,738,590 A 4/1998 Lochtefeld
5,741,189 A 4/1998 Briggs
5,761,776 A 6/1998 Vollebregt
5,762,024 A 6/1998 Meilahn
5,765,314 A 6/1998 Giglio et al.
5,766,082 A 6/1998 Lochtefeld et al.
5,779,553 A 7/1998 Langford
5,785,592 A 7/1998 Jacobsen
5,791,254 A 8/1998 Mares et al.
5,809,701 A 9/1998 Vollebregt
5,816,314 A 10/1998 Wiggs et al.
5,820,471 A 10/1998 Briggs
5,820,472 A 10/1998 Briggs
D403,392 S 12/1998 Briggs et al.
5,853,332 A 12/1998 Briggs
5,860,364 A 1/1999 McKoy
5,860,766 A 1/1999 Lochtefeld et al.
5,865,680 A 2/1999 Briggs
D406,871 S 3/1999 Briggs
D407,133 S 3/1999 Briggs
5,899,633 A 5/1999 Lochtefeld
5,899,634 A 5/1999 Lochtefeld
5,911,190 A 6/1999 Lochtefeld et al.
5,927,478 A 7/1999 Archer
D413,957 S 9/1999 Briggs
5,950,253 A 9/1999 Last
5,967,901 A 10/1999 Briggs
D416,066 S 11/1999 Briggs
5,978,593 A 11/1999 Sexton

(56) References Cited

U.S. PATENT DOCUMENTS 5,989,126 A 11/1999 Kilbert et al.
6,006,672 A 12/1999 Newfarmer et al.
D421,283 S 2/2000 Briggs et al.
6,036,603 A 3/2000 Mason et al.
6,045,449 A 4/2000 Aragona et al.
6,075,442 A 6/2000 Welch
6,089,987 A 7/2000 Briggs
6,105,527 A 8/2000 Lochtefeld et al.
6,113,506 A 9/2000 Nielsen
6,115,974 A 9/2000 Milanian
6,132,317 A 10/2000 Lochtefeld
6,132,318 A 10/2000 Briggs
6,139,382 A 10/2000 Eschbacher et al.
6,146,282 A 11/2000 McCready et al.
6,161,771 A 12/2000 Henry
6,162,127 A 12/2000 Ochi
6,174,242 B1 1/2001 Briggs et al.
6,178,692 B1 1/2001 Graven
6,186,902 B1 2/2001 Briggs
6,195,851 B1 3/2001 Vollebregt et al.
6,210,287 B1 4/2001 Briggs
6,231,451 B1 5/2001 Briggs
6,237,499 B1 5/2001 McKoy
6,258,037 B1 7/2001 Dowling
6,261,186 B1 7/2001 Henry
6,264,202 B1 7/2001 Briggs
6,265,977 B1 7/2001 Vega et al.
6,272,695 B1 8/2001 Brandner
6,276,353 B1 8/2001 Briggs et al.
6,280,342 B1 8/2001 Tod
6,283,871 B1 9/2001 Briggs
6,285,021 B1 9/2001 Fayfield
6,319,137 B1 11/2001 Lochtefeld
6,320,495 B1 11/2001 Sporgis
6,336,771 B1 1/2002 Hill
6,354,955 B1 3/2002 Stuart et al.
6,362,778 B2 3/2002 Neher
6,371,717 B1 4/2002 Grams et al.
6,375,578 B1 4/2002 Briggs
6,443,849 B1 9/2002 Byrd
6,460,201 B1 10/2002 Lochtefeld
6,475,095 B1 11/2002 Henry
6,488,590 B2 12/2002 Katayama
6,491,589 B1 12/2002 Lochtefeld
6,513,284 B1 2/2003 Sandlin
6,520,853 B2 2/2003 Suzuki
6,526,158 B1 2/2003 Goldberg
6,527,646 B1 3/2003 Briggs
6,533,191 B1 3/2003 Berger et al.
6,553,336 B1 4/2003 Johnson et al.
6,554,534 B1 4/2003 Butterfield
6,561,914 B2 5/2003 Henry
6,569,023 B1 5/2003 Briggs
6,579,175 B2 6/2003 Suzuki
6,604,327 B1 8/2003 Reville
6,605,044 B2 8/2003 Bimbaum
6,608,563 B2 8/2003 Weston et al.
6,634,949 B1 10/2003 Briggs et al.
6,651,268 B1 11/2003 Briggs
6,672,233 B2 * 1/2004 Wippermann ..... 114/66
6,676,530 B2 1/2004 Lochtefeld
6,702,687 B1 3/2004 Henry
6,708,706 B1 3/2004 Robinson
6,716,107 B2 4/2004 Lochtefeld
6,738,992 B2 5/2004 Lochtefeld
6,758,231 B1 7/2004 Lochtefeld et al.
6,773,355 B1 8/2004 Lekhtman
6,786,830 B2 9/2004 Briggs et al.
6,789,608 B1 9/2004 Wiggs
6,796,908 B2 9/2004 Weston
6,825,766 B2 11/2004 Hewitt et al.
6,830,146 B1 12/2004 Scully et al.
6,928,670 B2 8/2005 Lochtefeld et al.
6,957,662 B2 10/2005 Lochtefeld et al.
6,976,434 B2 12/2005 Roig et al.
7,004,847 B2 2/2006 Henry
7,029,400 B2 4/2006 Briggs
7,040,994 B2 5/2006 Lochtefeld et al.
RE39,171 E 7/2006 Lochtefeld
7,179,173 B2 2/2007 Henry et al.
7,218,231 B2 5/2007 Higham
7,229,359 B2 6/2007 Henry et al.
7,263,805 B2 9/2007 Chapus
7,278,028 B1 10/2007 Hingoranee
7,285,053 B2 10/2007 Henry et al.
7,370,208 B2 5/2008 Levin et al.
7,371,182 B2 5/2008 Henry et al.
7,371,183 B2 5/2008 Henry et al.
7,401,786 B2 7/2008 Lochtefeld
7,445,550 B2 11/2008 Barney et al.
7,491,128 B2 2/2009 Henry et al.
7,727,077 B2 6/2010 Henry
7,740,542 B2 6/2010 Henry et al.
7,752,815 B2 7/2010 Lauria et al.
7,758,435 B2 7/2010 Henry
7,762,899 B2 7/2010 Henry
7,762,900 B2 7/2010 Henry
7,766,753 B2 8/2010 Henry
7,775,894 B2 8/2010 Henry et al.
7,775,895 B2 8/2010 Henry et al.
7,775,896 B2 8/2010 Henry et al.
7,780,536 B2 8/2010 Henry et al.
7,785,207 B2 8/2010 Henry et al.
7,811,177 B2 10/2010 Henry et al.
7,815,514 B2 10/2010 Henry et al.
7,828,667 B2 11/2010 Henry et al.
7,850,527 B2 12/2010 Barney et al.
7,857,704 B2 12/2010 Henry et al.
7,921,601 B2 4/2011 Henry
7,942,752 B2 5/2011 Henry
8,070,615 B2 12/2011 Henry et al.
8,075,413 B2 12/2011 Henry et al.
8,079,916 B2 12/2011 Henry
8,096,892 B2 1/2012 Henry et al.
8,162,769 B2 4/2012 Henry
8,197,352 B2 6/2012 Henry et al.
8,210,954 B2 7/2012 Henry
8,251,832 B2 8/2012 Henry et al.
8,282,497 B2 10/2012 Henry et al.
2002/0072317 A1 6/2002 Livingston et al.
2002/0082097 A1 6/2002 Henry et al.
2002/0180155 A1 12/2002 Lochtefeld
2003/0031547 A1 2/2003 Stumvoll et al.
2003/0139218 A1 7/2003 Hlynka
2003/0203760 A1 10/2003 Henry et al.
2004/0033833 A1 2/2004 Briggs et al.
2004/0077423 A1 4/2004 Weston et al.
2005/0034768 A1 2/2005 Henry et al.
2005/0047869 A1 3/2005 Lochtefeld
2005/0085306 A1 4/2005 Henry et al.
2005/0090318 A1 4/2005 Henry et al.
2005/0090319 A1 4/2005 Henry et al.
2005/0090320 A1 4/2005 Henry et al.
2005/0090321 A1 4/2005 Henry et al.
2005/0090322 A1 4/2005 Henry et al.
2005/0143173 A1 6/2005 Barney et al.
2005/0148398 A1 7/2005 Lochtefeld et al.
2005/0286976 A1 12/2005 Lochtefeld et al.
2005/0288111 A1 12/2005 Cowan et al.
2006/0052171 A1 3/2006 Henry et al.
2006/0111195 A1 5/2006 Henry
2006/0111196 A1 5/2006 Henry
2006/0135274 A1 6/2006 Henry
2006/0142090 A1 6/2006 Henry
2006/0154726 A1 7/2006 Weston et al.
2006/0178222 A1 8/2006 Henry et al.
2006/0214805 A1 9/2006 Boujon
2006/0229134 A1 10/2006 Briggs et al.
2006/0258471 A1 11/2006 Briggs et al.
2006/0260697 A1 11/2006 Lochtefeld et al.
2006/0287030 A1 12/2006 Briggs et al.
2007/0033866 A1 2/2007 Henry
2007/0033867 A1 2/2007 Henry
2007/0033868 A1 2/2007 Henry

(56) References Cited

U.S. PATENT DOCUMENTS

| | | | |
|---|---|---|---|
| 2007/0049385 | A1 | 3/2007 | Henry |
| 2007/0049386 | A1 | 3/2007 | Henry |
| 2007/0049387 | A1 | 3/2007 | Henry |
| 2007/0049388 | A1 | 3/2007 | Henry |
| 2007/0051036 | A1 | 3/2007 | Henry |
| 2007/0051037 | A1 | 3/2007 | Henry |
| 2007/0051038 | A1 | 3/2007 | Henry |
| 2007/0051039 | A1 | 3/2007 | Henry |
| 2007/0054745 | A1 | 3/2007 | Henry et al. |
| 2007/0060402 | A1 | 3/2007 | Henry |
| 2007/0060403 | A1 | 3/2007 | Henry |
| 2007/0060404 | A1 | 3/2007 | Henry et al. |
| 2007/0066396 | A1 | 3/2007 | Weston et al. |
| 2007/0066410 | A1 | 3/2007 | Henry |
| 2007/0078016 | A1 | 4/2007 | Henry et al. |
| 2007/0087849 | A1 | 4/2007 | Henry et al. |
| 2007/0087850 | A1 | 4/2007 | Henry et al. |
| 2007/0087851 | A1 | 4/2007 | Henry et al. |
| 2007/0087852 | A1 | 4/2007 | Henry et al. |
| 2007/0087853 | A1 | 4/2007 | Henry et al. |
| 2007/0087854 | A1 | 4/2007 | Henry et al. |
| 2007/0197304 | A1 | 8/2007 | Henry et al. |
| 2007/0219004 | A1 | 9/2007 | Henry et al. |
| 2007/0249425 | A1 | 10/2007 | Weston et al. |
| 2008/0014835 | A1 | 1/2008 | Weston et al. |
| 2008/0021776 | A1 | 1/2008 | Lochtefeld |
| 2008/0216427 | A1 | 9/2008 | Lochtefeld |
| 2010/0160054 | A1 | 6/2010 | Henry |
| 2011/0014988 | A1 | 1/2011 | Henry et al. |
| 2011/0118039 | A1 | 5/2011 | Henry et al. |

FOREIGN PATENT DOCUMENTS

| | | | |
|---|---|---|---|
| DE | 4243812 | A1 | 6/1994 |
| DE | 129145 | | 1/2007 |
| DE | 4239303 | A1 | 6/2011 |
| EP | 1318864 | | 11/2005 |
| EP | 1604712 | | 12/2005 |
| WO | 92/03201 | | 3/1992 |
| WO | 92/04087 | | 3/1992 |
| WO | 97/33668 | | 9/1997 |
| WO | 98/45006 | | 10/1998 |
| WO | 01/10184 | | 2/2001 |
| WO | 02/22226 | | 3/2002 |
| WO | 02/22227 | | 3/2002 |
| WO | 2005/042124 | | 5/2005 |
| WO | 2006/057970 | | 6/2006 |
| WO | 2006/113936 | | 10/2006 |
| WO | 2007/019278 | | 2/2007 |
| WO | 2007/027841 | | 3/2007 |
| WO | 2007/028040 | | 3/2007 |
| WO | 2007/028042 | | 3/2007 |
| WO | 2007/028043 | | 3/2007 |
| WO | 2007/035524 | | 3/2007 |
| WO | 2007/106717 | | 9/2007 |

OTHER PUBLICATIONS

AA52—International Search Report and Written Opinion for PCT/US06/34264 mailed Jul. 24, 2007.
AA41—Exhibits related to the "Mountain Slidewinder" ride.
AA79—International Search Report and Written Opinion for PCT/US2007/063611 mailed Nov. 10, 2008.
AA80—European Office Action for EP 05019093.3 mailed Aug. 4, 2009.
Office Action for U.S. Appl. No. 11/244,866 mailed on Feb. 24, 2009.
Office Action for U.S. Appl. No. 11/244,866 mailed on Jun. 26, 2009.
Office Action for U.S. Appl. No. 11/244,866 mailed on Oct. 21, 2009.
Office Action for U.S. Appl. No. 11/244,869 mailed on Apr. 14, 2009.
Office Action for U.S. Appl. No. 11/244,869 mailed on Sep. 24, 2009.
Office Action for U.S. Appl. No. 11/407,862 mailed on Jun. 24, 2009.
Office Action for U.S. Appl. No. 11/407,862 mailed on Nov. 30, 2009.
Office Action for U.S. Appl. No. 11/407,861 mailed on Mar. 12, 2009.
Office Action for U.S. Appl. No. 11/407,861 mailed on Oct. 15, 2009.
Office Action for U.S. Appl. No. 11/407,874 mailed on Jul. 14, 2009.
Office Action for U.S. Appl. No. 11/407,874 mailed on Dec. 1, 2009.
Office Action for U.S. Appl. No. 11/407,886 mailed on Jul. 13, 2009.
Office Action for U.S. Appl. No. 11/407,886 mailed on Nov. 18, 2009.
Office Action for U.S. Appl. No. 11/407,845 mailed on Apr. 16, 2009.
Office Action for U.S. Appl. No. 11/407,845 mailed on Oct. 16, 2009.
Office Action for U.S. Appl. No. 11/407,885 mailed on Jan. 30, 2009.
Office Action for U.S. Appl. No. 11/407,885 mailed on Dec. 2, 2009.
Office Action for U.S. Appl. No. 11/513,338 mailed on Aug. 21, 2009.
Office Action for U.S. Appl. No. 11/513,338 mailed on Dec. 10, 2009.
Office Action for U.S. Appl. No. 11/215,747 mailed on May 18, 2009.
Office Action for U.S. Appl. No. 11/215,747 mailed on Oct. 23, 2009.
Office Action for U.S. Appl. No. 11/215,795 mailed on Feb. 26, 2009.
Office Action for U.S. Appl. No. 11/215,795 mailed on Jun. 23, 2009.
Office Action for U.S. Appl. No. 11/218,330 mailed on Mar. 20, 2009.
Office Action for U.S. Appl. No. 11/215,795 mailed on Nov. 18, 2009.
Office Action for U.S. Appl. No. 11/218,330 mailed on Jul. 22, 2009.
Advisory Action for U.S. Appl. No. 11/218,330 mailed on Nov. 9, 2009.
Office Action for U.S. Appl. No. 11/283,503 mailed on Mar. 10, 2009.
Office Action for U.S. Appl. No. 11/283,503 mailed on Aug. 13, 2009.
Co-Pending U.S. Appl. No. 12/338,535 entitled, "Themed Amusement River Ride System" to Henry filed Dec. 18, 2008.
AA74—Examiner's Report for Australian Patent Application No. 2004285488 mailed Sep. 19, 2008.
Office Action for U.S. Appl. No. 11/244,866 mailed on Mar. 26, 2008.
Office Action for U.S. Appl. No. 11/244,866 mailed on Sep. 23, 2008.
Office Action for U.S. Appl. No. 11/244,869 mailed on Apr. 8, 2008.
Office Action for U.S. Appl. No. 11/244,869 mailed on Nov. 13, 2008.
Office Action for U.S. Appl. No. 11/407,862 mailed on Aug. 27, 2008.
Office Action for U.S. Appl. No. 11/407,874 mailed on Sep. 8, 2008.
Office Action for U.S. Appl. No. 11/407,886 mailed on Sep. 9, 2008.
Office Action for U.S. Appl. No. 11/407,845 mailed on Oct. 17, 2008.
Office Action for U.S. Appl. No. 11/407,885 mailed on Sep. 5, 2008.
Office Action for U.S. Appl. No. 11/513,338 mailed on Jun. 12, 2008.
Office Action for U.S. Appl. No. 11/513,338 mailed on Dec. 10, 2008.
Office Action for U.S. Appl. No. 11/215,747 mailed on Mar. 18, 2008.
Office Action for U.S. Appl. No. 11/215,747 mailed on Oct. 24, 2008.
Office Action for U.S. Appl. No. 11/215,795 mailed on Mar. 17, 2008.
Office Action for U.S. Appl. No. 11/215,795 mailed on Oct. 9, 2008.
AA77—International Search Report and Written Opinion for PCT/US06/33955 mailed Apr. 4, 2008.
Office Action for U.S. Appl. No. 11/218,330 mailed on Mar. 25, 2008.
Office Action for U.S. Appl. No. 11/218,330 mailed on Sep. 23, 2008.
Office Action for U.S. Appl. No. 11/283,503 mailed on Mar. 28, 2008.
Office Action for U.S. Appl. No. 11/283,503 mailed on Sep. 26, 2008.
Decision on Appeal for U.S. Appl. No. 10/985,178 mailed on May 2, 2012.
Notice of Allowance for U.S. Appl. No. 11/215,795 mailed on Jun. 7, 2012.
Notice of Allowance for U.S. Appl. No. 12/838,136 mailed on Apr. 25, 2012.
Co-Pending U.S. Patent Appl. No. 11/407,862 entitled, "Composite Tree" to Henry et al. filed Apr. 20, 2006.

(56) References Cited

OTHER PUBLICATIONS

Co-Pending U.S. Appl. No. 11/407,861 entitled, "Tree With Elevated Structure" to Henry et al. filed Apr. 20, 2006.
Co-Pending U.S. Appl. No. 11/407,875 entitled, "Water Amusement System With Elevated Structure" to Henry et al. filed Apr. 20, 2006.
Co-Pending U.S. Appl. No. 11/407,874 entitled, "Thematic Tree System" to Henry et al. filed Apr. 20, 2006.
Co-Pending U.S. Appl. No. 11/407,886 entitled, "Water Amusement System With Trees" to Henry et al. filed Apr. 20, 2006.
Co-Pending U.S. Appl. No. 11/407,845 entitled, "Lift Apparatus for Base-Mounted Plant" to Henry et al. filed Apr. 20, 2006.
Co-Pending U.S. Appl. No. 11/407,885 entitled, "Tree With Covering Apparatus" to Henry et al. filed Apr. 20, 2006.
Co-Pending U.S. Appl. No. 11/512,709 entitled, "Methods and Systems for Self-Contained Floating Marine Parks" to Henry et al. filed Aug. 30, 2006.
Co-Pending U.S. Appl. No. 11/513,314 entitled, "Methods and Systems for Active Filtration of Portions of Self-Contained Floating Marine Parks" to Henry et al. filed Aug. 30, 2006.
Co-Pending U.S. Appl. No. 11/512,708 entitled, "Water Amusement System and Method Including a Self-Contained Floating Marine Park" to Henry et al. filed Aug. 30, 2006.
Co-Pending U.S. Appl. No. 11/513,315 entitled, "Methods and Systems for Positionable Screen for Self-Contained Floating Marine Parks" to Henry et al. filed Aug. 30, 2006.
Co-Pending U.S. Appl. No. 11/513,338 entitled, "Methods and Systems for Thermal Control Systems for Self-Contained Floating Marine Parks" to Henry et al. filed Aug. 30, 2006.
Co-Pending U.S. Appl. No. 11/512,737 entitled, "Methods and Systems for Modular Self-Contained Floating Marine Parks" to Henry et al. filed Aug. 30, 2006.
Co-Pending U.S. Appl. No. 11/215,357 entitled, "Methods and Systems for Amusement Park ConveyorS" to Henry et al. filed Aug. 30, 2005.
Co-Pending U.S. Appl. No. 11/215,736 entitled, "Water Amusement Park Conveyor Barriers" to Henry et al. filed Aug. 30, 2005.
Co-Pending U.S. Appl. No. 11/215,757 entitled, "Adjusting Participant Flow Rate in Water Amusement ParkS" to Henry et al. filed Aug. 30, 2005.
Co-Pending U.S. Appl. No. 11/215,795 entitled, "Modular Water Amusement Park Conveyors" to Henry et al. filed Aug. 30, 2005.
Co-Pending U.S. Appl. No. 11/215,351 entitled "Water Amusement Park Conveyor Support Elements" to Henry et al. filed Aug. 30, 2005.
Co-Pending U.S. Appl. No. 11/244,864 entitled, "Water Amusement Park Water Channel Flow System" to Henry et al. filed Oct. 6, 2005.
Co-Pending U.S. Appl. No. 11/244,872 entitled, "Water Amusement Park Water Channel and Adjustable Flow Controller" to Henry et al. filed Oct. 6, 2005.
Co-Pending U.S. Appl. No. 11/512,713 entitled, "Water Circuit Interactive Games, Exercise, and Gambling" to Henry et al. filed Aug. 30, 2006.
Co-Pending U.S. Appl. No. 11/512,710 entitled, "Amusement Water Rides Involving Exercise Circuit" to Henry et al. filed Aug. 30, 2006.
Co-Pending U.S. Appl. No. 11/522,056 entitled, "Amusement Water Rides Involving Games of Chance" to Henry et al. filed Sep. 15, 2006.
Co-Pending U.S. Appl. No. 11/375,361 entitled, "Method and System of Positionable Covers for Water Amusement Parks" to Henry et al. filed Mar. 14, 2006.
Co-Pending U.S. Appl. No. Unknown entitled, "Continuous Water Ride Method and System for Water Amusement Parks" to Henry et al. filed Dec. 8, 2006.
AA95—Office Action for Korean Patent Application No. 10-2006-7010049 mailed on Nov. 30, 2011.
Notice of Allowance for U.S. Appl. No. 11/244,869 mailed on Dec. 13, 2011.
AA94—First Examiner's Report for Australian Patent Application No. 2006236172 mailed Sep. 21, 2011.
Non-Final Office Action for U.S. Appl. No. 11/215,795 mailed on Nov. 23, 2011.
Non-Final Office Action for U.S. Appl. No. 11/512,710 mailed on Nov. 8, 2011.
Notice of Allowance for U.S. Appl. No. 11/708,644 mailed on Sep. 29, 2011.
AA91—Communication pursuant to Article 94(3) for EP 04 796 139.6-2318 mailed Mar. 15, 2011.
Final Office Action for U.S. Appl. No. 11/244,869 mailed on Mar. 10, 2011.
Advisory Action for U.S. Appl. No. 11/244,869 mailed on Jun. 6, 2011.
AA92—Examiner's Second Report for Australian Patent Application No. 2005309695 mailed Apr. 29, 2011.
Final Office Action for U.S. Appl. No. 11/407,862 mailed on May 2, 2011.
Final Office Action for U.S. Appl. No. 11/407,874 mailed on Mar. 17, 2011.
Final Office Action for U.S. Appl. No. 11/407,885 mailed on Mar. 10, 2011.
Advisory Action for U.S. Appl. No. 11/407,885 mailed on Jun. 9, 2011.
Final Office Action for U.S. Appl. No. 11/513,338 mailed on Mar. 24, 2011.
Advisory Action for U.S. Appl. No. 11/513,338 mailed on Jun. 3, 2011.
Final Office Action for U.S. Appl. No. 11/215,795 mailed on May 2, 2011.
Final Office Action for U.S. Appl. No. 11/512,710 mailed on May 26, 2011.
Office Action for U.S. Appl. No. 12/338,535 mailed on Apr. 1, 2011.
AA93—Communication pursuant to Article 94(3) for EP 05019093.3 mailed May 3, 2011.
Final Office Action for U.S. Appl. No. 11/283,503 mailed on Mar. 25, 2011.
Final Office Action for U.S. Appl. No. 11/708,644 mailed on May 11, 2011.
Notice of Allowance for U.S. Appl. No. 11/636,406 mailed on Jul. 26, 2011.
Advisory Action for U.S. Appl. No. 11/407,862 mailed on Aug. 10, 2011.
Office Action for U.S. Appl. No. 11/407,862 mailed on Aug. 19, 2011.
Office Action for U.S. Appl. No. 11/407,861 mailed on Aug. 5, 2011.
Advisory Action for U.S. Appl. No. 11/407,874 mailed on Jun. 14, 2011.
Advisory Action for U.S. Appl. No. 11/407,845 mailed on May 9, 2011.
Office Action for U.S. Appl. No. 11/407,845 mailed on Aug. 24, 2011.
Final Office Action for U.S. Appl. No. 11/215,747 mailed on Aug. 15, 2011.
Advisory Action for U.S. Appl. No. 11/215,795 mailed on Aug. 25, 2011.
Advisory Action for U.S. Appl. No. 11/512,710 mailed on Sep. 6, 2011.
Office Action for U.S. Appl. No. 12/838,136 mailed on Sep. 7, 2011.
Notice of Allowance for U.S. Appl. No. 12/338,535 mailed on Aug. 5, 2011.
Notice of Allowance for U.S. Appl. No. 11/283,503 mailed on Jul. 15, 2011.
Advisory Action for U.S. Appl. No. 11/708,644 mailed on Sep. 6, 2011.
Co-Pending U.S. Appl. No. 12/838,136 entitled, "Method and System of Positionable Covers for Water Amusement Parks" to Henry filed Jul. 16, 2010.
AA85—Supplementary European Search Report for EP 04 79 6139 mailed Jun. 4, 2010.
Advisory Action for U.S. Appl. No. 11/244,866 mailed on Jun. 15, 2010.
Office Action for U.S. Appl. No. 11/244,869 mailed on May 27, 2010.
Office Action for U.S. Appl. No. 11/407,862 mailed on May 29, 2010.
Office Action for U.S. Appl. No. 11/407,874 mailed on Apr. 30, 2010.
Office Action for U.S. Appl. No. 11/407,886 mailed on May 20, 2010.
Office Action for U.S. Appl. No. 11/407,885 mailed on Apr. 28, 2010.

(56) References Cited

OTHER PUBLICATIONS

Office Action for U.S. Appl. No. 11/513,338 mailed on Jun. 24, 2010.
Office Action for U.S. Appl. No. 11/215,795 mailed on Jun. 15, 2010.
Office Action for U.S. Appl. No. 11/218,330 mailed on Jun. 15, 2010.
Office Action for U.S. Appl. No. 11/283,503 mailed on May 18, 2010.
Office Action for U.S. Appl. No. 11/244,866 mailed on Mar. 26, 2010.
Office Action for U.S. Appl. No. 11/244,869 mailed on Jan. 29, 2010.
AA82—Extended European Search Report for European Application No. 05 851 944.8 mailed on Jan. 13, 2010.
Office Action for U.S. Appl. No. 11/407,861 mailed on Mar. 17, 2010.
Office Action for U.S. Appl. No. 11/407,845 mailed on Apr. 5, 2010.
Office Action for U.S. Appl. No. 11/215,747 mailed on Feb. 25, 2010.
Office Action for U.S. Appl. No. 11/218,330 mailed on Feb. 17, 2010.
Advisory Action for U.S. Appl. No. 11/283,503 mailed on Oct. 27, 2009.
Office Action for U.S. Appl. No. 11/283,503 mailed on Jan. 12, 2010.
AA90—Office Action for Canadian Patent Application No. 2,543,542 mailed on Dec. 29, 2010.
Office Action for U.S. Appl. No. 11/636,406 mailed on Jan. 21, 2011.
Notice of Allowance for U.S. Appl. No. 11/244,866 mailed on Jan. 3, 2011.
Office Action for U.S. Appl. No. 11/407,861 mailed on Feb. 14, 2011.
Office Action for U.S. Appl. No. 11/708,644 mailed on May 28, 2010.
Office Action for U.S. Appl. No. 11/708,644 mailed on Nov. 26, 2010.
Office Action for U.S. Appl. No. 11/215,747 mailed on Jan. 28, 2011.
Final Office Action for U.S. Appl. No. 11/407,845 mailed on Jan. 31, 2011.
Office Action for U.S. Appl. No. 11/218,330 mailed on Dec. 30, 2010.
AA96—Communication pursuant to Article 94(3) for EP 04 796 139.6-2318 mailed May 23, 2012.
AA97—Office Action for Canadian Patent Application No. 2,588,985 mailed on May 23, 2012.
AA18—Rorres, C. "The Turn of the Screw: Optimal Design of an Archimedes Screw" J. of Hydraulic Engineering, Jan. 2000, vol. 126, No. 1, pp. 72-80.
AA21—Office Action for U.S. Appl. No. 10/693,654 mailed on Dec. 7, 2004.
AA22—Office Action for U.S. Appl. No. 10/693,654 mailed on Jun. 10, 2005.
AA34—Office Action for U.S. Appl. No. 10/985,178 mailed on Apr. 20, 2005.
AA35—Office Action for U.S. Appl. No. 10/985,178 mailed on Oct. 3, 2005.
AA36—Office Action for U.S. Appl. No. 10/985,178 mailed on May 18, 2006.
AA33—Office Action for U.S. Appl. No. 09/952,036 mailed on Feb. 9, 2006.
AA23—International Search Report for PCT/US01/28542 mailed Mar. 27, 2002.
AA24—Written Opinion for PCT/US01/28542 mailed May 2, 2002.
AA25—Written Opinion for PCT/US01/28542 issued Aug. 5, 2002.
AA26—International Preliminary Examination Report for PCT/US01/28542 issued Dec. 2, 2002.
AA27—Written Opinion for 01 970 881.7-2307 mailed Apr. 13, 2004.
AA28—Written Opinion for 01 970 881.7-2307 mailed Oct. 21, 2004.
AA30—European Search Report for EP 05019093.3 mailed Oct. 28, 2005.
AA14—International Search Report for PCT/US01/28535 mailed Mar. 27, 2002.
AA15—Written Opinion for PCT/US01/28535 mailed May 2, 2002.
AA16—Written Opinion for PCT/US01/28535 mailed Aug. 6, 2002.
AA17—International Preliminary Examination Report for PCT/US01/28535 issued Jan. 13, 2003.
AA38—Exhibits related to the "Gravity Groove" slide (Sep. 1995).
AA29—Engineering drawing (as well as photographs of the finished product) for the Silver Dollar City water slide in Branson, Missouri, the date is unknown, however there is a 1986 copyright on the engineering drawing.
Co-Pending U.S. Appl. No. 12/941,215 entitled, "Methods and Systems for Viewing Marine Life from Self-Contained Floating Marine Parks" to Henry et al. filed Nov. 8, 2010.
Final Office Action for U.S. Appl. No. 11/636,406 mailed on Sep. 15, 2010.
Advisory Action for U.S. Appl. No. 11/244,866 mailed on Aug. 20, 2010.
Office Action for U.S. Appl. No. 11/244,869 mailed on Nov. 3, 2010.
AA88—Examiner's First Report for Australian Patent Application No. 2005309695 mailed Jun. 16, 2010.
AA86—Communication Pursuant to Article 94(3) EPC for European Application No. 05 851 944.8 mailed on Aug. 16, 2010.
Office Action for U.S. Appl. No. 11/407,862 mailed on Sep. 9, 2010.
Office Action for U.S. Appl. No. 11/407,874 mailed on Sep. 9, 2010.
Notice of Allowance for U.S. Appl. No. 11/407,886 mailed on Nov. 17, 2010.
Office Action for U.S. Appl. No. 11/407,845 mailed on Aug. 24, 2010.
Final Office Action for U.S. Appl. No. 11/407,885 mailed on Sep. 9, 2010.
Final Office Action for U.S. Appl. No. 11/407,861 mailed on Sep. 30, 2010.
Final Office Action for U.S. Appl. No. 11/215,747 mailed on Sep. 20, 2010.
Office Action for U.S. Appl. No. 11/215,795 mailed on Oct. 20, 2010.
Office Action for U.S. Appl. No. 11/512,710 mailed on Oct. 29, 2010.
Office Action for U.S. Appl. No. 12/338,535 mailed on Oct. 19, 2010.
AA89—Communication pursuant to Article 94(3) for EP 05019093.3 mailed Aug. 12, 2010.
Advisory Action for U.S. Appl. No. 11/283,503 mailed on Aug. 9, 2010.
AA87—Examiner Requisition for Canadian Patent Application No. 2,654,714 mailed Jun. 9, 2010.
Non-Final Office Action for U.S. Appl. No. 11/407,861 mailed on Mar. 8, 2012.
Final Office Action for U.S. Appl. No. 11/407,874 mailed on Feb. 22, 2012.
Final Office Action for U.S. Appl. No. 11/407,845 mailed on Feb. 23, 2012.
Notice of Allowance for U.S. Appl. No. 11/512,710 mailed on Feb. 14, 2012.
Notice of Allowance for U.S. Appl. No. 11/218,330 mailed on Mar. 22, 2012.

* cited by examiner

METHODS AND SYSTEMS FOR VIEWING MARINE LIFE FROM SELF-CONTAINED FLOATING MARINE PARKS

PRIORITY CLAIM

This patent application is a continuation of U.S. patent application Ser. No. 11/513,314 entitled "METHODS AND SYSTEMS FOR ACTIVE FILTRATION OF PORTIONS OF SELF-CONTAINED FLOATING MARINE PARKS" filed on Aug. 30, 2006, which claims priority to U.S. Provisional Patent Application Ser. No. 60/713,847 entitled "FLOATING WATER PARK" filed on Sep. 2, 2005, the disclosure of which is hereby incorporated by reference.

BACKGROUND OF THE INVENTION

1. Field of the Invention

The present disclosure generally relates to water amusement attractions and rides. More particularly, the disclosure generally relates to a floating water park and a system and method for water transportation. Further, the disclosure generally relates to water-powered rides and to a system and method in which participants may be actively involved in a water attraction.

2. Description of the Relevant Art

The popularity of participatory family water recreation facilities (e.g., water parks) and water rides in amusement parks has increased in recent years. Traditional water rides (e.g., waterslides, river rapid rides, log flumes) require participants to walk or be mechanically lifted to the ride entrance, from which gravity enables water, riding vehicles, and/or riders to slide down a chute or incline to a splash pool at a lower elevation. Although some water rides move riders uphill as well, these rides also generally start on an elevated tower and may require walking up steps or an incline to reach the ride entrance.

Traditional downhill water rides are typically short in duration (normally measured in seconds of ride time) and have limited throughput capacity. The combination of these two factors may result in long queue line waits of up to two or three hours for a relatively short ride. Additional problems (e.g., hot and sunny weather, wet patrons, excessive walking) may result in poor customer satisfaction or low perceived entertainment value in the water park experience.

Transportation between rides or areas of a large amusement park may be provided by a mechanical transportation system (e.g., train or monorail). These forms of transportation may be passive in nature, with little if any guest-controlled functions (e.g., choice of pathway, speed of riders, rider activity). Typical amusement park transportation systems may be unsuitable for water parks because of high installation and operating costs. In addition, water park guests are often wet and may prefer to stay wet and/or be more active to offset heat loss due to water immersion and evaporative cooling. Thus, integrating transportation with water rides through a water park may be desirable.

For water rides that involve the use of a vehicle (e.g., a floatation device such as an inner tube or floating board), a rider may be required to carry the vehicle from the exit of the ride to the start of the ride. Vehicles could be transported from the exit to the entrance of the ride using mechanical transportation devices, but these devices may be expensive to install and operate. Delays and/or effort associated with carrying and/or transporting vehicles may cause excess wear and tear on the vehicles, reduce guest enjoyment, contribute to guest injuries, and inhibit guest access to the rides. Also, a water park that includes several non-integrated rides may require different vehicles for one or more rides, thereby increasing operating expenses and complicating logistics. Thus, use of common vehicles for a variety of rides may be advantageous.

Water park rides may require substantial waiting periods in a queue line due to the large number of participants at the park. In some embodiments, a series of corrals may be used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, resulting in physical discomfort and/or lowered guest satisfaction. Additionally, these queue lines may be difficult for physically disabled guests to negotiate.

In some water parks, rides and other attractions far from the main entrance may be underused relative to rides and attractions close to the main entrance. Queue lines for popular rides may be overcrowded. Unbalanced overcrowding may lead to guest dissatisfaction and less than optimal guest dispersal throughout the park. An efficient method of transportation between rides in a water park may alleviate these problems.

The geographic location of a water park may restrict the length of the operating season of the water park. For example, a water park may be closed due to low winter temperatures. Additionally, a water park may be closed due to inclement weather such as rain, windstorms, and/or other disruptive conditions that might reduce enjoyment and/or compromise safety of participants. Limiting the number of days a water park is open may reduce the profitability of the water park.

Availability of suitable land may limit development of water parks. While it is desirable to locate water parks close to a high concentration of potential participants, land prices, especially for large tracts of land, may be prohibitively expensive near large metropolitan areas or popular vacation destinations.

SUMMARY

In some embodiments, a system and method for overcoming land shortage problems associated with developing water parks may include utilizing areas unsuitable for other types of development (e.g., areas substantially covered with water). For example, land covered with water may include man-made and natural bodies of water. Land developed for water parks may include temporary bodies of water, wherein an area of land is only flooded during part of the year. The land may be flooded under controlled conditions and/or flooded due to seasonal changes in the weather. Land covered with water may include, but is not limited to lakes, oceans, seas, gulfs, bays, catchment areas, swamps, marshes, bayous, canals, and ponds.

Some bodies of water are ignored or considered an eyesore including, but not limited to, catchment areas, marshes, or swamps. Catchment areas may be generally defined as a structure, such as a basin or reservoir, used for collecting or draining water. Bodies of water such as these may be unused and/or undeveloped, particularly for recreational purposes (e.g., swimming, fishing, or boating).

In some embodiments, a floating water park may be developed in a body of water. Locating a water park in a body of water may provide several advantages, such as greatly reducing costs associated with procuring real estate. This may be especially true when constructing a water park adjacent the ocean, where developing a floating water park (e.g., in a marina) may be significantly more cost effective than developing a water park on oceanfront property. Furthermore, a floating water park may be more environmentally friendly than a land-based water park.

In some embodiments, a floating water park may be modular. "Modular" may be generally defined as being designed with standardized units or dimensions, as for easy assembly and repair or flexible arrangement and use. In some embodiments, a modular floating water park may facilitate on-site assembly and disassembly of the water park. Relocating a water park may be advantageous for reasons including, but not limited to, profitability, seasonal weather fluctuations, or seasonal tourism fluctuations. The ability to disassemble, transport, and reassemble a water park may assuage environmental impact concerns associated with a land-based water park.

In some embodiments, a water park may be combined with other entertainment concepts. A water park may include one or more other venues including, but not limited to, hotels, restaurants, and arcades. In certain embodiments, a water park may include elements traditionally associated with a marine park. As used herein, a "marine park" is a park including an aquatic region protected for recreational use. A theme park featuring aquatic life may include features of, for example, a marine park, a public aquarium, and zoo, with aquatic life kept inside, outside in enclosed tanks, or secured in the aquatic region. Mechanical elements associated with moving and handling water may be common to both water parks and marine parks, thereby facilitating integration of the two themes.

In some embodiments, facilities associated with a land-based water park may be positioned adjacent a floating water park. In certain embodiments, water park facilities may be positioned aboard a floating watercraft (e.g., a barge). Water park facilities may include electrical and/or mechanical support, administrative offices, hotels, restaurants, etc. In some embodiments, a floating water park may be coupled to one or more land-based facilities. Land based facilities may include water parks, amusement parks, restaurants, hotels, and/or casinos. A floating water park may be coupled to a marina used to dock watercraft. A land-based facility may be coupled to the marina and/or to the floating water park.

In some embodiments, a floating water park (e.g., a floating marine park) may include one or more floating containers. Floating containers may include floatation devices. Floatation devices may be adjusted such that at least a portion (e.g., a majority) of a floating container is positioned above a body of water. In embodiments including two or more floating containers, floating containers may be coupled such that participants can move between the floating containers. In certain embodiments, floating containers may be coupled by floating and/or suspended water channels or water rides. Floating containers may be coupled such that participants in at least one of the containers can view the contents of another floating container. A "view window" may allow participants to view aquatic life in one floating container from another floating container.

In some embodiments, a body of water surrounding a floating water park may function as a type of insulation and/or thermal barrier. The body of water may function as a thermal well or heat sink, absorbing and/or dissipating at least a portion of available energy. Fluid in the body of water may collect available energy from a variety of sources. Available energy may include solar energy. Solar energy collected by fluid in the body of water may be stored and/or transferred to fluid in floating containers in the body of water.

In some embodiments, a floating marine park may include a heat exchange system. A heat exchange system may function to exchange heat between fluid in at least one of the containers and any fluid in which the container is floating.

In some embodiments, a floating container may include a zero-edge entry. A zero-edge entry may be formed at least in part by granules. Granules may be generally defined as small grains or pellets. The granules may be smaller than, roughly the same size as, and/or larger than an average grain of sand associated with naturally occurring beaches. Granules may include naturally occurring sand and/or artificial (e.g., man-made) sand. Forming at least a portion of a zero-edge entry from sand may create the feel of a beach setting and thereby add to participant enjoyment of the water park.

In some embodiments, a floating container may include fresh water for use by participants and/or freshwater aquatic life (e.g., freshwater tropical fish). In certain embodiments, a floating container may include salt water for use by marine life and/or participants who wish to observe and/or interact with the marine life. A floating water park may allow a participant to interact closely with marine life in a controlled environment. In some embodiments, a water park may include one or more land-based or floating docks from which participants may access a natural, uncontrolled environment (e.g., a beach, a bay, a gulf, a river).

In some embodiments, one or more floating containers of a floating water park may be used for various purposes during different seasons of the year. For example, a floating water park may be used for education, entertainment, recreation, and/or scientific research during the summer. At other times during the year, floating containers and facilities associated with the floating containers of a floating water park may be used for other related industries including, but not limited to, hatcheries and/or fish farms. Thus, the same facilities used for entertainment and recreation may have other profitable uses.

In some embodiments, one or more containers may be positioned separately or nested in a floating container. For example, one or more containers may float separately in a floating container, or one or more containers may be nested in one or more other containers floating in a body of water. One or more containers floating in a floating container may include fluids.

In some embodiments, a floating container or system of floating containers forming a floating water park may float freely within a body of water. In some embodiments, at least some portions of a floating water park may be coupled to a foundation or to one or more sides of the body of water. In certain embodiments, at least a portion of a floating water park may be anchored to a foundation of the body of water.

A water transportation system may advantageously transport participants between traditional water rides in a water park. A water transportation system may relieve participants from carrying their vehicles up to the start of a water ride and allow riders to stay in the water between rides. In some embodiments, a water transportation system may be used to transport guests between rides in a water park, past rides and areas of high guest density in a water park, from one side of a water park to another, between water parks, and/or between guest facilities such as hotels, restaurants, and shopping centers. In certain embodiments, a water transportation system may be an attraction (e.g., a ride) with exciting water and situational effects used to connect traditional water rides in a water park. A water transportation system, therefore, may be an entertaining and enjoyable part of the water park experience, allowing riders to spend more of their time in the water between rides and/or destinations.

In certain embodiments, a water park may include a continuous water ride. Continuous water rides may include a system of individual water rides (e.g., two or more) connected together. Water rides may include downhill water slides, uphill water slides, single tube slides, multiple participant tube slides, space bowls, sidewinders, interactive water slides, water rides with falling water, themed water slides, dark water rides, and accelerator sections in water slides. Connecting water rides may reduce long queue lines normally associated with individual water rides. Connecting water rides may allow participants to remain in the water and/or in or on a vehicle (e.g., a floatation device) during transportation from a first portion of the continuous water ride to a second portion of the continuous water ride.

In some embodiments, a continuous water ride may include an elevation system to transport a participant and/or vehicle from a first elevation to a second elevation. The first elevation may be different than the second elevation. The first elevation may include an exit point of a first water ride. The second elevation may include an entry point of a second water ride. In some embodiments, a first and second elevation may include exit and entry points of a single water ride. Elevation systems may include any number of water and non-water based systems capable of safely increasing the elevation of a participant and/or vehicle. Elevation systems may include, but are not limited to, spiral transports, water wheels, ferris locks, conveyor belt systems, water lock systems, uphill water slides, and/or tube transports.

A continuous water ride may allow guests to conveniently access remote (e.g., under-utilized) areas of the park, thereby effectively increasing park capacity and/or allowing guests to self-regulate overcrowding at locations within the system by readily bypassing a high density area in favor of a low density area. A continuous water ride may advantageously reduce waiting time in queue lines. In some embodiments, a continuous water ride may allow physically disabled guests to enjoy multiple and extended rides with one vehicle without repeatedly entering and exiting the water. In certain embodiments, a continuous water ride may reduce the amount of walking required of guests and/or the likelihood of injuries (e.g., slip and fall injuries) sustained by guests. A continuous water ride may allow park operators to provide guests with a single vehicle for use throughout a water park and/or reduce a number of distinct vehicles used in a water park. A continuous water ride may require less handling (e.g., dragging) of vehicles and thereby extend the life of the vehicles compared to those manually or mechanically transported between rides.

In some embodiments, a vehicle is a flotation device. A vehicle may be flexible and/or buoyant. In certain embodiments, a vehicle may be inflated. For example, a vehicle may be an inflated inner tube of any size and/or shape. An inflated vehicle may be inflated with any type of gas. For example, an inflated vehicle may be inflated with air. In certain embodiments, a vehicle may hold two or more riders at once.

Water park safety may be increased by monitoring vehicles and/or riders throughout a water park. For example, a lifeguard may monitor a ride to determine if rider and vehicle become separated during a ride. An automated monitoring system may be used advantageously to monitor participants in a water park. An automated monitoring system embodiment may include participant identifiers. In some embodiments, a participant identifier includes a band. A band may be removably coupled to a participant. In certain embodiments, a participant identifier is wirelessly coupled to one or more sensors positioned in a water park. Sensors positioned in a water park may be used to monitor participant identifiers. Sensors may be able to collect data based on interaction with participant identifiers within a certain area. Data collected by the sensors may be transferred to a system controller or a system processor. Collected data may be used to assess when a participant has been separated from a vehicle. Signals from participant identifiers may use, but are not limited to, radio frequency signaling or global positioning technology.

In some embodiments, positionable screens may be used to substantially enclose at least a portion of a water park during inclement weather. In certain embodiments, two or more positionable screens may be retractable/extendable relative to one another. Positionable screens may be used to trap and/or recirculate heat lost from the water beneath or within the screens. Positioning of the screens may be operated automatically and/or manually. In some embodiments, positionable screens are constructed of materials that allow transmission of most of the visible light spectrum while inhibiting transmission of potentially harmful radiation.

In some water park system embodiments, a programmable logic control system may be used to adjust system parameters remotely and/or automatically. For example, a control system may be used to control water flow/shutdown in a water park during normal operating conditions. In certain embodiments, a control system may have remote sensors and/or diagnostic programs to identify/assess/report problems and/or to signal various pumps, gates, or other devices to address problems as needed.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
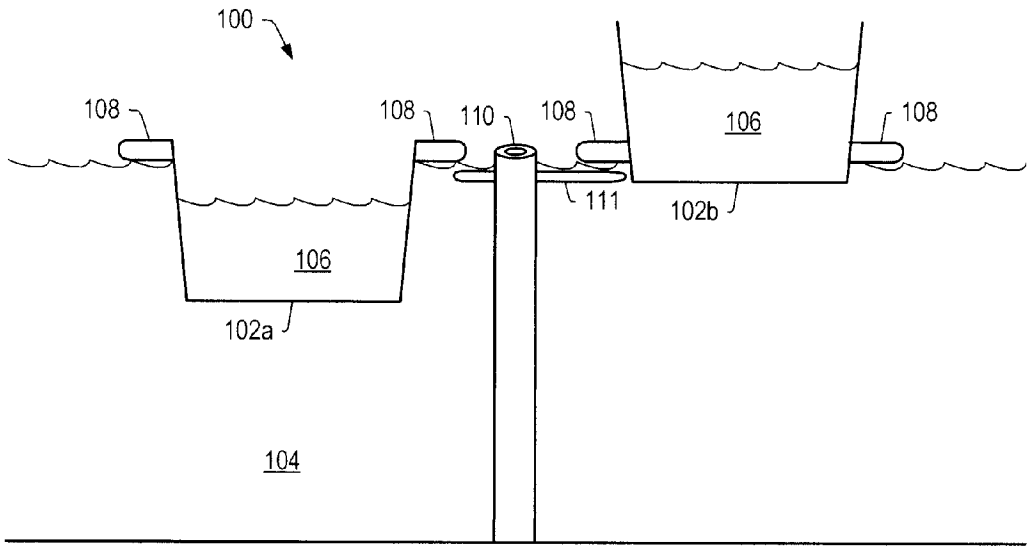
FIG. 1 depicts an embodiment of a portion of a floating water park including two floating containers.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an" and "the" include plural referents unless the content clearly dictates otherwise. Thus, for example, reference to "a linker" or "a linking element" includes a combination of two or more linkers or linking elements; reference to "a substituent" includes mixtures of substituents.

Unless defined otherwise, all technical and scientific terms used herein have the same meaning as commonly understood by one of ordinary skill in the art.

The term "catchment areas" as used herein generally refers to a structure, such as a basin or reservoir, used for collecting or draining water and/or run off water.

The term "coupled" as used herein generally means either a direct connection or an indirect connection (e.g., one or more intervening connections) between one or more objects or components.

The phrase "directly attached" as used herein generally means a direct connection between objects or components.

The phrase "floating container" as used herein generally refers to any object that can be used to hold things, which is capable of floating in a fluid (e.g., water). The floating container may float due to materials from which the container itself is formed and/or due to floatation devices coupled to the floating container.

The term "granules" as used herein generally refers to small grains or pellets. The granules may be smaller than, roughly the same size as, and/or larger than an average grain of sand associated with naturally occurring beaches. Granules may include naturally occurring sand and/or artificial (e.g., man-made) sand.

The term "living coral reef" as used herein generally refers to a deposit comprising the calcareous skeletons secreted by various anthozoans.

The phrase "marine life" as used herein generally refers to any form of life of or relating to the sea, native to or inhabiting the sea, and/or capable of inhabiting a salt water environment as found in most oceans and seas.

The term "participant" as used herein generally refers to persons participating in water recreational activities.

The term "salt water" as used herein generally refers to water with salt, as that of the ocean and of certain seas and lakes, such that the levels of salt in the water is capable of supporting species of plants and animals which live in a natural salt water ocean or similar environment.

The term "substantially isolated" as used herein generally refers to when two or more materials (e.g., fluids) are inhibited from contacting or mixing with one another, this however does not exclude systems where small portions of one material does intermingle with a second material for various reasons (e.g., runoff, inadvertent overflows, high waves or swell washing over the side of a floating container).

The term "support" as used herein generally means a first element, directly or indirectly, locates or positions a second element by pushing or pulling on the second element. The first element may be directly attached or coupled to the second element when providing support. The first element may be in compression while pushing or in tension while pulling on the second element.

A floating water park and may include one or more floating containers. FIG. 1 depicts an embodiment of a portion of floating water park 100 including floating containers 102*a*, 102*b*. Floating containers 102*a*, 102*b* are positioned in body of water 104. Body of water 104 may be natural or man-made. Floating container 102*a*, 102*b* may include fluid 106. Fluid 106 may be, for example, fresh water or salt water, or any other fluid known which is capable of supporting life (e.g., brackish water). In some embodiments, aquatic life may be supported in floating containers 102*a*, 102*b*. In certain embodiments, participants may swim, float, scuba dive, etc. in floating containers 102*a*, 102*b*. In some embodiments, a participant may use floating container 102 as an entrance to body of water 104 (e.g., a lake, an ocean). For example, a dock coupled to floating container 102 may be used as a base for water activities (e.g., scuba diving, snuba, snokeling) in body of water 104. In some embodiments, one or more additional containers may be positioned in fluid 106. In certain embodiments, floating containers 102 may be coupled (e.g., to allow movement of participants between the floating containers). For example, floating containers 102 may be coupled by floating and/or suspended water channels, traditional or continuous water rides, elevation systems, water slides (e.g., uphill and downhill) and/or transportainment systems.

In some embodiments, a floating marine life and water amusement system may include two or more floating containers configured to float in a first fluid. Two or more of the floating containers may be coupled to one another. One or more of the floating containers may function to contain a second fluid such that the majority of the second fluid is substantially isolated from the first fluid. One or more of the floating containers may function to contain marine life, and one or more of the floating containers may function to contain one or more participants in water amusement activities.

In some embodiments, a water amusement ride may be coupled to a floating marine system. A channel may convey a participant through at least a portion of a water amusement system by using water flowing through the channel. The water amusement system may include the water amusement ride and at least a second water amusement ride. The channel may be coupled to at least the two water amusement rides. Two or more of the floating containers may be coupled to one another. In some embodiments, a channel may be coupled to a water amusement ride and a floating marine system.

In some embodiments, a water ride may include at least one water releasing mechanism. The water releasing mechanism may function to inject water onto a surface of the water ride such that a body of flowing water is produced on the surface of the water ride.

A floating water park may be positioned in any natural or artificial body of water. Natural bodies of water may include, but are not limited to, oceans, seas, lakes, rivers, marinas, gulfs, marshes, and/or swamps. Artificial bodies of water may include, but are not limited to basins, reservoirs, catchments, and/or man made lakes. In some embodiments, a floating water park may be positioned in an area which has varying levels of water. The level of water may vary for different reasons (e.g., the seasons, rainfall amounts, opening and closing of flood gates on a dam). In some instances a floating water park may be positioned in an area which may be dry sometimes of the year and have water other times of the year. An area such as this may include a catchment area. A catchment may include, but is not limited to, a basin or a reservoir. A catchment may collect runoff water from surrounding areas.

For example, land covered with water may include man-made and natural bodies of water. Land developed for water parks may include temporary bodies of water, wherein an area of land is only flooded during part of the year. The land may be flooded under controlled conditions and/or flooded due to seasonal changes in the weather. Land covered with water may include, but is not limited to lakes, oceans, seas, gulfs, bays, catchment areas, swamps, marshes, bayous, canals, and ponds.

Some bodies of water are ignored or considered an eyesore including, but not limited to, catchment areas, marshes, or swamps. Catchment areas may be generally defined as a structure, such as a basin or reservoir, used for collecting or draining water. Bodies of water such as these may be unused and/or undeveloped, particularly for recreational purposes (e.g., swimming, fishing, or boating).

In some embodiments, a floating water park may be modular. "Modular" may be generally defined as being designed with standardized units or dimensions, as for easy assembly and repair or flexible arrangement and use. In some embodiments, a modular floating water park may facilitate on-site assembly and disassembly of the water park. Relocating a water park may be advantageous for reasons including, but not limited to, profitability, seasonal weather fluctuations, or seasonal tourism fluctuations. The ability to disassemble, transport, and reassemble a water park may assuage environmental impact concerns associated with a land-based water park.

In some embodiments, a floating marine life and water amusement system may include two or more floating containers configured to float in a first body of a first fluid. Two or more of the floating containers may be configured to be assembled and used at a first site, dissembled, and then reassembled and used at a second site.

In some embodiments, two or more of the floating containers may function to be coupled such that the floating marine park system is assembled at a first site. The coupled floating containers may function to be decoupled such that the decoupled floating containers are transportable to a second site. At the second site the decoupled floating containers may be coupled such that the floating marine park system is reassembled at the second site. Any number of methods and/or systems known to one skilled in the art may be employed to couple and recouple different portions of a floating marine park.

In some embodiments, floating container 102 may be coupled to one or more floatation devices 108. Floatation devices 108 may provide buoyancy to floating containers 102. Floatation devices 108 may include, but are not limited to, pontoons, floating concrete, boat dock systems, or combinations thereof. In some embodiments, floatation devices 108 may be coupled to a portion of a floating water park using a track system. In some embodiments, the track system may include a ratchet mechanism to secure floatation device 108 in place. In certain embodiments, floatation devices 108 may be adjustably coupled to floating containers 102*a*, 102*b* to allow the floating containers to be positioned as desired relative to the surface of body of water 104. As shown in FIG. 1, floatation devices 108 may be adjusted such that a majority of floating container 102*b* extends above the surface of body of water 104. The ability to adjust a position of floating container 102 in body of water 104 may allow participants in the floating container to view aquatic life and planned events within the body of water (e.g., a natural marine habitat). In some embodiments, floating water park 100 may be coupled to a marine park, allowing a participant to interact closely with marine life in a controlled environment.

Floating containers may include any number of species of aquatic life for participants to view and/or interact with. Aquatic life may include, but is not limited to, sea turtles, manta rays, and dolphins. The number and amount of species is only limited by imagination and the size and number of floating containers forming a floating marine/water amusement park. In some embodiments, coral reefs may be cultivated and/or transplanted from the wild in floating containers. Coral reefs are a popular diving and natural viewing platform for participants, adding a touch of realism and are natural microenvironments for species on display at floating marine parks. Coral reefs may include a living coral reef. A coral reef may function as a habitat for marine life. A living coral reef may function as a habitat for marine life typically associated with living coral reefs in the living coral reefs natural environment. In some embodiments, a coral reef may include natural elements, artificial elements, and/or some combination of both.

In some embodiments, floating containers forming a floating marine park may be employed for different purposes during different seasons of the year. In some embodiments, during the summer season a floating marine park may be used as a basis for education, entertainment, and even scientific research. During tourism off seasons including, but not limited to, the winter season, floating containers and facilities associated with the floating containers forming a floating marine park may be employed for other related industries (e.g., aquaculture). Industries related in that they use many of the same facilities and equipment as a floating marine park would use. In some embodiments, related industries may include hatcheries and/or fish farms for food. The same facilities that provide a habitat for aquatic life for entertainment and education may be converted into facilities directed towards farming fish for food and profit.

In some embodiments, one or more floating containers may function to contain marine life for production/consumption during one or more seasons of a year, and to contain marine life for educational/entertainment during one or more seasons of a year. One or more of the floating containers may convert from containing marine life for production/consumption during one or more seasons of a year to containing marine life for educational and/or entertainment during one or more seasons of a year. For example, one or more of the floating containers may convert from containing marine life for production/consumption during one or more cold seasons of a year to containing marine life for educational and/or entertainment during one or more warm seasons of a year.

In some embodiments, body of water 104 may function as a type of insulation/thermal barrier. Fluids in body of water 104 may function as a thermal well or heat sink, absorbing and dissipating at least a portion of available energy. Fluids in body of water 104 may collect available energy (e.g., solar energy) for storage or transfer to fluid 106 in floating containers 102. In some embodiments, body of water 104 may include a barrier (e.g., a liner) to reduce fluid loss, reduce leaching of contaminants from the surroundings to the body of water, and/or reduce transfer of contaminants from the body of water to the surroundings. In certain embodiments, a barrier may be a thermal blanket.

In some embodiments, a floating marine life and water amusement system may include two or more floating containers configured to float in a first fluid. The system may include a heat exchange system which functions to exchange heat between the first fluid and fluid in at least one of the containers. Underground heat exchange systems are known to one skilled in the art. As is well known, underground temperatures are maintained at a stable level throughout all seasons and are little affected by atmospheric temperature. In practice the underground zone located at a distance of 5 to 6 meters as measured from the ground surface has a substantially constant temperature. It has been found as a result or practical measurements that the surface temperature of the ground varies as atmospheric temperature varies but that the temperature at a deep, underground position is higher in the winter than in the summer. This is attributable to a huge heat capacity underground. During summer, this surface zone of the ground is warmed under hot sunshine and thus stored thermal energy is gradually transmitted to a deep zone underground with the time delay in the winter to heat the latter, and thereby resulting in the above-mentioned peculiar phenomenon. This means that temperature in the deep zone in the underground is kept at a level opposite to that in the atmosphere due to time lag in the transmittance of thermal energy. Thus, the underground has more stable temperatures in the deeper zone but as the depth as measured from the ground surface increases further, underground temperatures gradually increase due to the influence of heat conduction from the magma layer in the earth. It should be noted that heat exchanging is achieved quickly because of underground water.

In some embodiments, an underground heat exchange system may be employed to exchange heat stored within the earth with heat stored within a first fluid and/or within fluids contained within one or more of the floating containers to heat/cool the fluid. In some embodiments, heat exchange systems may be adapted to exchange heat between the first fluid and fluids contained within one or more of the floating containers. Examples of heat exchange systems which facilitate movement of heat between bodies (e.g., bodies of water) are illustrated in U.S. Pat. Nos. 6,789,608 and 5,623,986 to Wiggs, U.S. Pat. No. 5,816,314 to Wiggs, et al., U.S. Pat. No. 5,461,876 to Dressler, and by U.S. Pat. No. 4,741,388 to Kuriowa, each of which is incorporated by reference as if fully set forth herein.

In some embodiments, other systems used to gather energy may be employed to provide energy/heat to a heat exchange system. For example, solar panels may be used to proved energy/heat to a heat exchange system.

In some embodiments, one or more anchor devices may function to couple at least one of the floating containers to the ground. One or more of the anchor devices may include a pile. One or more of the anchor devices may extend from a foundation of a body of fluid to at least a surface of the fluid. One or more of the floating containers may be coupled to one or more of the anchor devices such that the floating containers are inhibited from moving laterally while allowed to move vertically with the level of the first fluid. One or more of the floating containers may be coupled to one or more of the anchor devices such that the floating containers are inhibited from moving laterally outside of a predetermined range while allowed to move vertically with the level of the first fluid.

In some embodiments, one or more floating containers 102 may float freely within body of water 104. In some embodiments, one or more floating containers may be coupled to a bottom surface of a body of water. For example, floating container 102 may be anchored to a bottom of body of water 104. In certain embodiments, one or more anchors (e.g., elongated members 110) may be coupled or connected to a bottom of body of water 104. Elongated member 110 may be, for example, a piling. Elongated member 110 may extend from the bottom of the body of water up to and/or above the surface of the water, as depicted in FIG. 1. Elongated member 110 may be formed from materials including, but not limited to, cement, treated wood, steel etc.

In some embodiments, one or more elongated members 110 may be coupled to floating container 102 using rigid members to further inhibit movement of the floating container. In certain embodiments, one or more elongated members 110 may be coupled to floating container 102 using flexible members 111 to allow a desired amount of movement. Length and/or stiffness of flexible members may be adjustable to more or less movement of floating container 102.

Figure 2:
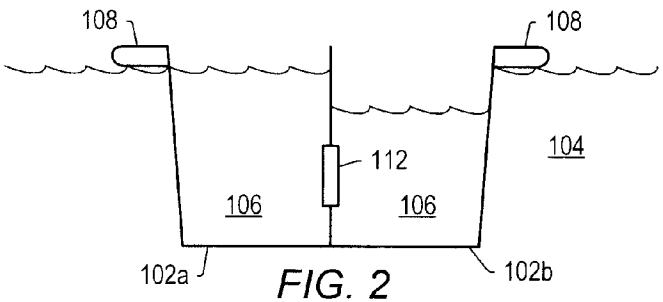
FIG. 2 depicts an embodiment of a portion of a floating water park including two floating containers coupled by a view window.

In some embodiments, two or more floating containers may be coupled such that participants in at least one of the containers can view the contents of another floating container. FIG. 2 depicts an embodiment of a portion of floating water park 100 including floating containers 102*a*, 102*b* coupled by window 112. Window 112 may be made of transparent material including, but not limited to, glass, polycarbonate, acrylic, or combinations thereof. Window 112 may be formed in any portion of a floating container 102 (e.g., bottom and/or side).

In some embodiments, a view window may function to allow fluid transfer between a first floating container and a second floating container. The view window may function to inhibit marine life and/or participants from moving between the first floating container and the second floating container.

In some embodiments, a view window may function to inhibit fluid transfer between the first floating container and the second floating container. The view window may function to inhibit marine life and/or participants from moving between the first floating container and the second floating container.

In some embodiments, all or a portion of floating container 102 (e.g., one or more panels) may be formed of one or more substantially transparent materials. A view window positioned in an outer wall of a floating container may allow participants to view events and aquatic life in body of water 104. One or more portions of one or more of the floating containers may be substantially transparent. The floating container including a substantially transparent portion may float above a bottom surface of a first body of the first fluid such that participants may view marine life within the first body of the first fluid.

In some embodiments, an access point may function to allow participants to enter/exit one or more of the floating containers. The access point may include a gradually sloping beach portion. At least a portion of the access point may function as a filter. The gradually sloping beach portion may include granules. At least a portion of the granules may include sand. At least a portion of the access point may function as a filter for fluids contained within the floating containers. The access point may include a floating island, described herein, positioned in one or more of the floating containers.

In some embodiments, a portion of a beach in a floating container may act as a natural filter to clean impurities from fluid in the floating container. Beach filter areas may include natural sand and/or man-made granules and one or more other materials including, but not limited to charcoal and gravel, to facilitate the filtering process. Various sizes of granular material may be employed to vary the filtering characteristics of the beach filter areas. In some embodiments, one or filter materials may be mixed together or layered. For example, sand may be layered over gravel such that the sand filters the water and the gravel inhibits displacement of the sand. Fluid within a floating container may naturally overflow through portions of the beach. In some embodiments, one or more pumps may be used to facilitate flow through a portion of a beach and/or other filtering devices.

In some embodiments, a floating water park may include a filtration system (e.g., a floating filtration system). A floating filtration system may be positioned as desired (e.g., completely submerged, partially submerged, floating on the surface) in fluid in a floating container. An upper portion of a filtration system may be at least partially covered (e.g., with sand) to disguise the filter and/or to provide a recreational surface (e.g., a beach). In some embodiments, sand on a portion of a filtration system may serve as a pre-filter for water entering the filtration system. Filtrations systems based, at least partially, on sand as a filtration media are known to one skilled in the art. Filtration systems may be more fully described in U.S. Pat. No. 4,073,722 to Grutsch, et al., which is incorporated by reference as if fully set forth herein.

Figure 3:
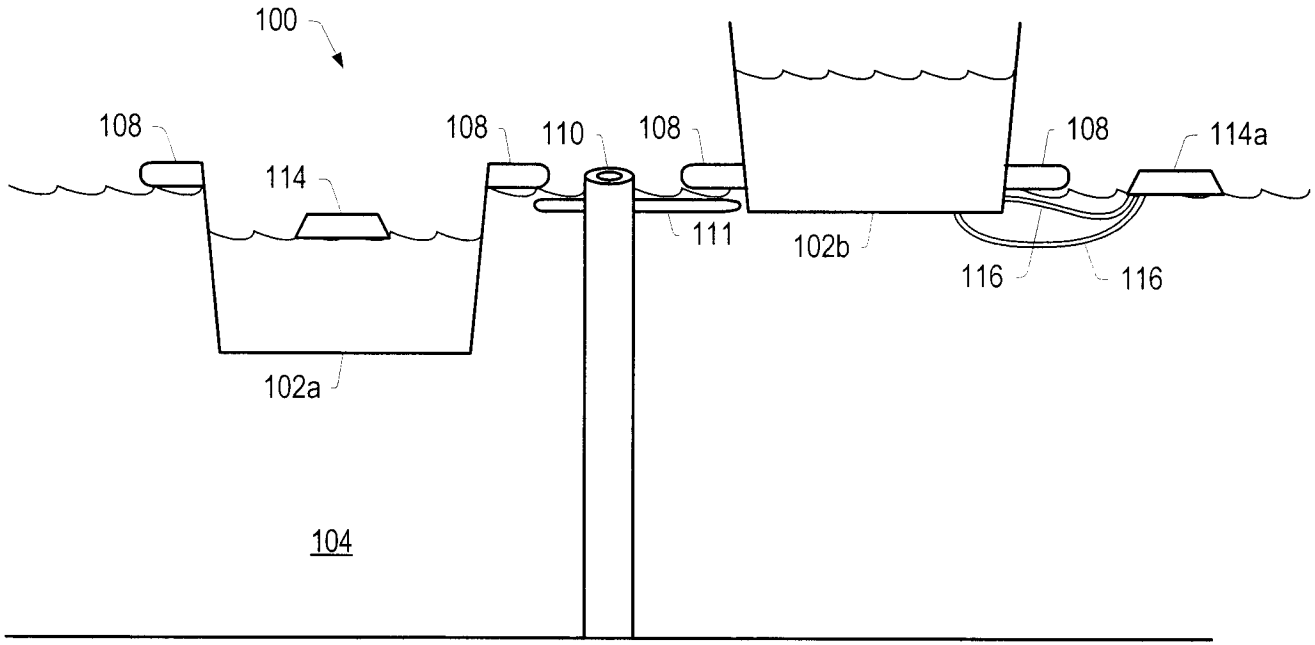
FIG. 3 depicts an embodiment of a portion of a floating water park including two floating containers with floating filtration systems.

FIG. 3 depicts an embodiment of a portion of floating water park 100 with floating container 102 and filtration system 114. Filtration system 114 may be positioned inside or outside of floating container 102. For example, filtration system 114 may be secured to floating container 102 or float freely or within certain limits in the floating container. Positioning filtration system 114*a* outside of floating container 102 may facilitate access to the filtration system for maintenance and/or may facilitate disposal of waste removed from fluid 106. In some embodiments, filtration system 114*a* is coupled to fluid transfer system 116. Fluid transfer system 116 may transfer fluid from floating container 102 to filtration system 114*a*. Filtration system 114 may filter the fluid and transfer the fluid back to floating container 102. In some embodiments, filtration system 114 may treat fluid with chemicals (e.g., ozone) or radiation (e.g., ultraviolet radiation).

Filtration system 114 may be active, passive, or a combination thereof. For example, filtration system 114 may switch between passive and active modes automatically and/or manually. A passive filtration system may filter water that naturally flows through openings in the filtration system (e.g., due to artificial and/or natural currents in the water). An active filtration system may include one or more pumping systems to pump water through one or more filters at a predetermined and adjustable rate. Filtration system 114 may be any filtration system known in the art including, but not limited to sand, cartridge, or diatomaceous earth filtration systems.

Other equipment and/or systems including, but not limited to, engines, electrical generators and related equipment, desalination plants, waste management systems, weather monitoring systems, security systems, and combinations thereof may be coupled to or positioned in floating containers of a floating water park. In some floating water park embodiments, facilities including, but not limited to, water rides, pools, restaurants, hotels, arcades, theaters, docks, offices, and employee facilities may be coupled to or positioned on floating containers or housed on floating docks or barges. Positioning facilities on barges and/or floating docks may advantageously facilitate the movement of these facilities as desired due to, for example, seasonal tourism fluctuations and/or cold or inclement weather.

Figure 4:
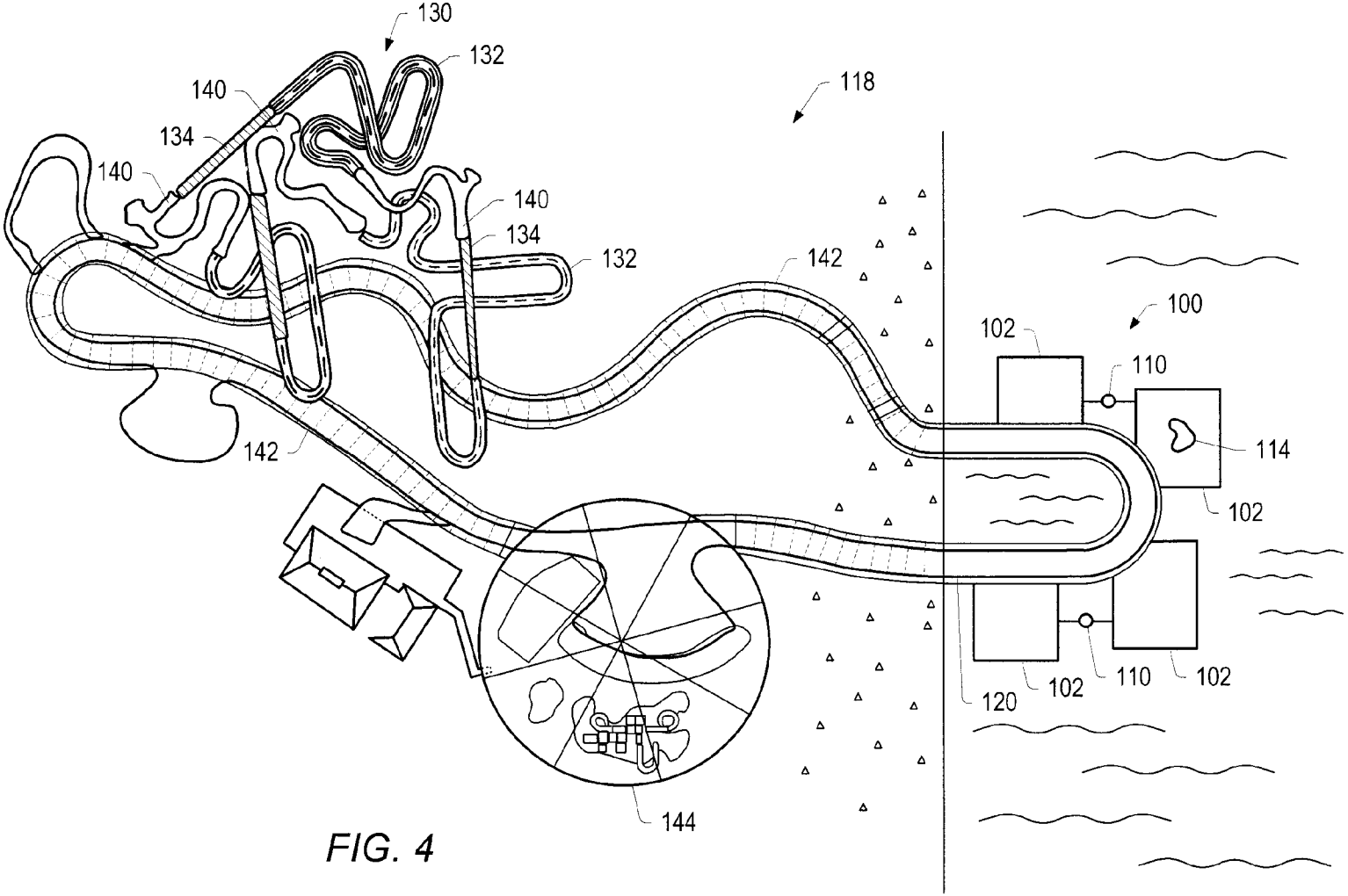
FIG. 4 depicts an embodiment of a floating water park coupled to an embodiment of a land-based water park.

In some embodiments, a floating water park may be coupled to a land-based facility (e.g., an amusement park, a water park). FIG. 4 depicts an embodiment of floating water park 100 coupled to an embodiment of land-based water park 118. Coupling floating water park 100 to land-based water park 118 may facilitate transfer of participants between the two water parks. In some embodiments, lazy river 120 may couple land-based water park 118 to the floating water park 100. Other entertainment facilities (e.g., amusement parks, restaurants, casinos, hotels) may be coupled to floating water park 100 and/or land-based water park 118. In some embodiments, a water ride and/or elevation system may be used to transport participants between land-based water park 118 and floating water park 100.

In some embodiments, a floating water park may include a deep flow channel in one of the floating containers, in a channel connecting portions of a floating water park, and/or in a channel connecting a floating water park to a land based facility. A deep flow channel may utilize the linear movement of a large quantity of water of floating depth at minimal slopes so that a participant is moved by the water rather than through it. High volume pumps at low water heads may move large quantities of water to create varying water velocity characteristics. Water may be pumped through a deep flow channel at one rate through a first portion and at another rate through a second portion. Depth, width, slope, and/or curvature along the length of a deep flow channel may vary to achieve the desired velocity and flow characteristics of the flowing water. Entrances and exits for participants may be provided on one or more portions of a deep flow channel. A body of water (e.g., reservoir) within a first portion of the channel may supply water for the channel. The body of water may be used for swimming, wading, sunbathing, diving, and other water recreation.

A floating water park may be assembled adjacent a marina. In some embodiments, a floating water park may be coupled to a marina. The marina may be coupled to nearby land. Such a system may allow participants to access the floating water park via the marina. In some embodiments, a floating water park may be positioned at least partially within a portion of a marina. Advantages of positioning a floating water park within a marina include using the marina as a breakwater for the floating water park. A breakwater may be generally defined as a barrier that protects a harbor, shore, and/or structure from the full impact of waves. A floating water park may be positioned behind a natural or manmade breakwater to protect the floating water park from waves. A breakwater may assist in protecting a floating water park from large natural or man-made swells or waves. A breakwater may assist in protecting a floating water park from natural disasters (e.g., hurricanes).

Associating a marina with a floating water park may allow participants to access the water park via personal watercraft as well as passenger ships (e.g., cruise ships). Cruise ships may provide large numbers of potential participants to a floating water park. In some embodiments, local ferries may be able to dock at a floating water park and/or a marina coupled to the floating water park.

Figure 5:
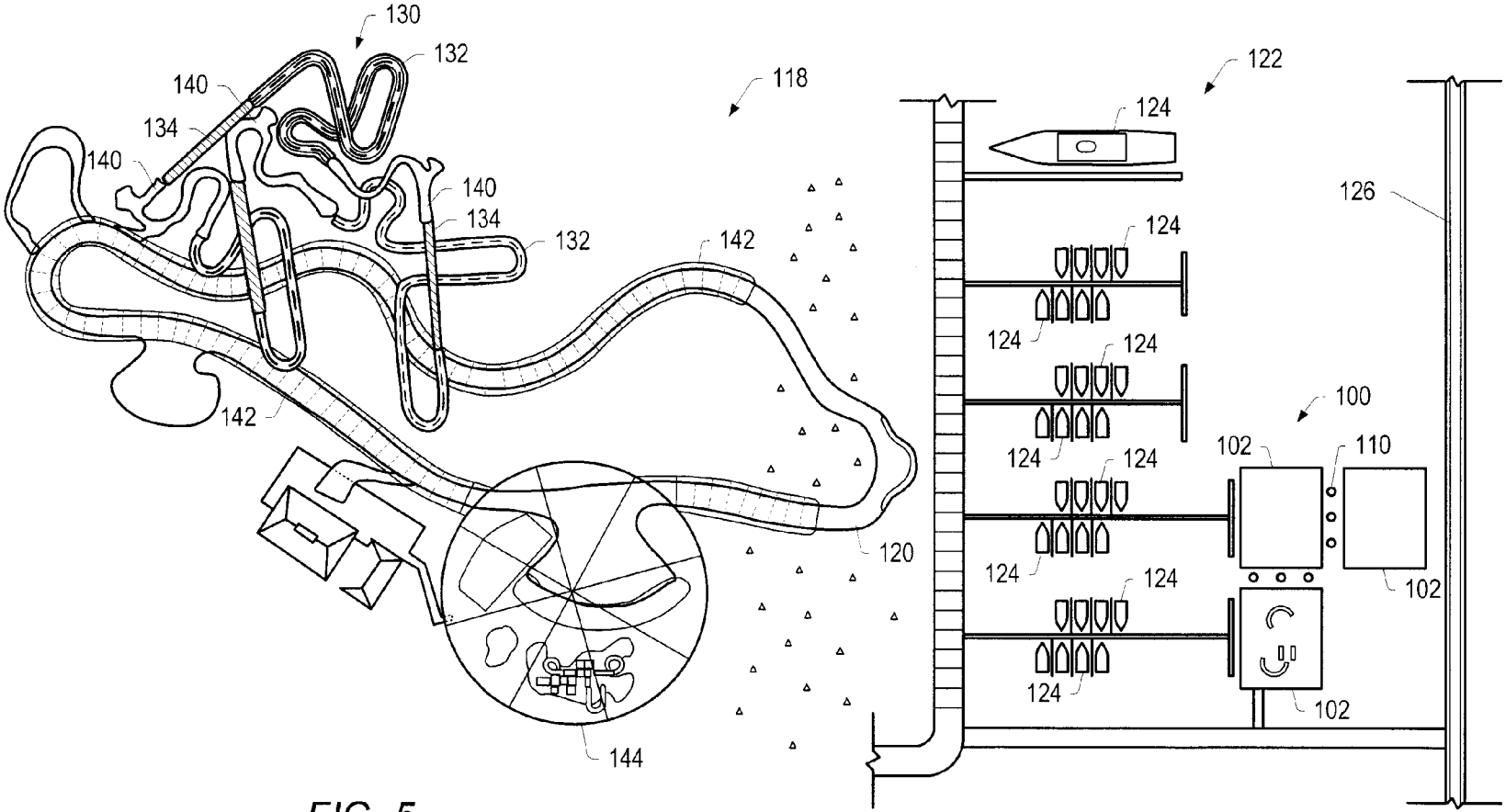
FIG. 5 depicts an embodiment of a portion of a floating water park coupled to an embodiment of a land-based water park and a marina.

FIG. 5 depicts an embodiment of a portion of floating water park 100 coupled to an embodiment of land based water park 118 and marina 122. Lazy river 120 depicted in FIG. 5 may be employed to connect the land based water park to the marina. Watercraft 124 (e.g., personal and commercial boats, cruise ships) may dock adjacent floating water park 100. In some embodiments, floating water park 100 may be protected by waterbreak 126. Waterbreak 126 may be natural (e.g., coral reef, sand bar) or artificial (e.g., floating aluminum or concrete barricades). A waterbreak may function to protect at least a portion of a floating water park. One or more portions of a floating water park may be positioned in a body of a water (e.g., ocean) behind a waterbreak. The waterbreak may function to dissipate at least a portion of the energy contained within incoming waves, which might otherwise damage the floating water park upon impact.

Figure 6:
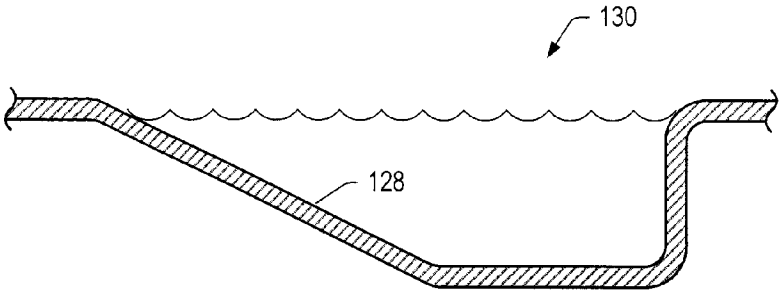
FIG. 6 depicts a representation of a cross section of an embodiment of a zero-edge entry point into a water ride.

In some embodiments, an area of a water ride may include a "zero-edge" entry point 128 as depicted in FIG. 6. FIG. 6 depicts a representation of a cross-section of an embodiment of a zero-edge entry point 128 into a continuous water ride 130. A zero-edge entry point may be generally defined as an entry into a water ride or body of water where there are few edges, or no edges, and/or no sudden drop offs at the entry point. For example, a zero-edge entry may not include steps. A zero-edge entry point may be designed such that a participant is not required to consciously step down to move from a first elevation to a second elevation. A zero-edge entry may increase the safety of guests/participants as they enter the water. Many participants may feel much safer entering the water using a zero-edge entry point as opposed to using steps or as opposed to a drop off entry point into the water. In some embodiments, a zero-edge entry point may be positioned adjacent synthetic trees such that guests may more safely enter the water.

In some embodiments, a floating container may include a zero-edge entry. A zero-edge entry may be formed at least in part by granules. Granules may be generally defined as a small grain or pellet. The granules may be smaller than, roughly the same size as, and/or larger than an average size of naturally occurring sand associated with naturally occurring beaches. Granules may include naturally occurring sand and/or man-made versions of sand. Forming at least a portion of a zero-edge entry from sand may facilitate the illusion of a beach setting. Emulating a beach setting may add to the enjoyment of participants using the water park.

In some embodiments, a water amusement system (e.g., a water park) may include a "continuous water ride." The continuous water ride may allow a participant using the continuous water ride to avoid long lines typically associated with many water amusement systems. Long lines and/or wait times are one of the greatest problems associated with water amusement systems in the area of customer satisfaction.

In some embodiments, continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or a vehicle (e.g., a floatation device) during transportation from a first portion of the continuous water ride to a second portion of the continuous water ride.

In some embodiments, an exit point of a first water ride may be connected to an entry point of a second water ride forming at least a portion of a continuous water ride. The exit point of the first water ride and the entry point of the second water ride may be at different elevation levels. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants and/or one or more vehicles from a first point at one elevation level to a second point at a different elevation level. Elevation systems may include a conveyor belt system. Elevation systems may include a water lock system. Elevation systems may include an uphill water slide, a spiral transport system, and/or a water wheel.

Figure 7:
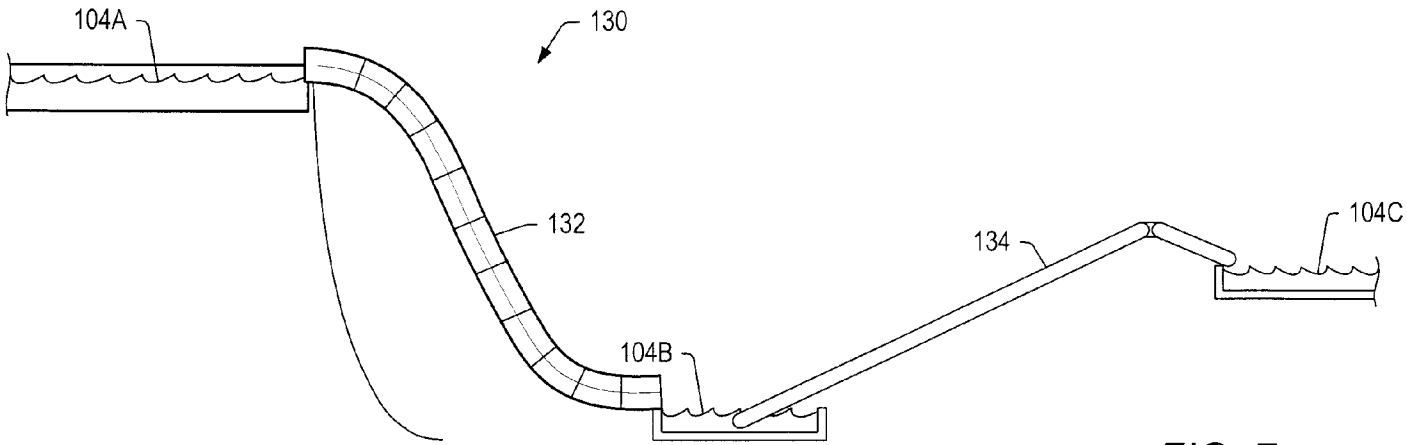
FIG. 7 depicts an embodiment of a portion of a continuous water slide.

FIG. 7 depicts an embodiment of at least a portion of continuous water ride 130. Continuous water ride 130 may include body of water 104A. Body of water 104A may include pools, lakes, and/or wells. Body of water 104A may be natural, artificial, or an artificially modified natural body of water. A non-limiting example of an artificially modified natural body of water might include a natural lake which has been artificially enlarged and adapted for water amusement park purposes (e.g., entry ladders and/or entry steps). Continuous water ride 130 may include downhill water slide 132. Downhill water slide 132 may convey participants from body of water 104A at a first elevation to a lower second elevation into typically some type of water container (e.g., body of water, channel, floating queue line, and/or pool). The water container at the lower second elevation may include, for illustrative purposes only, second body of water 104B (e.g., a pool). Continuous water ride 130 may include elevation system 134. Elevation system 134 may include any system capable of safely moving participants and/or vehicles from a lower elevation to a higher elevation. Elevation system 134 is depicted as a conveyor belt system in FIG. 7. Elevation system 134 may convey participants to body of water 104C. FIG. 7 depicts merely a portion of one embodiment of continuous water ride 130.

Figure 8:
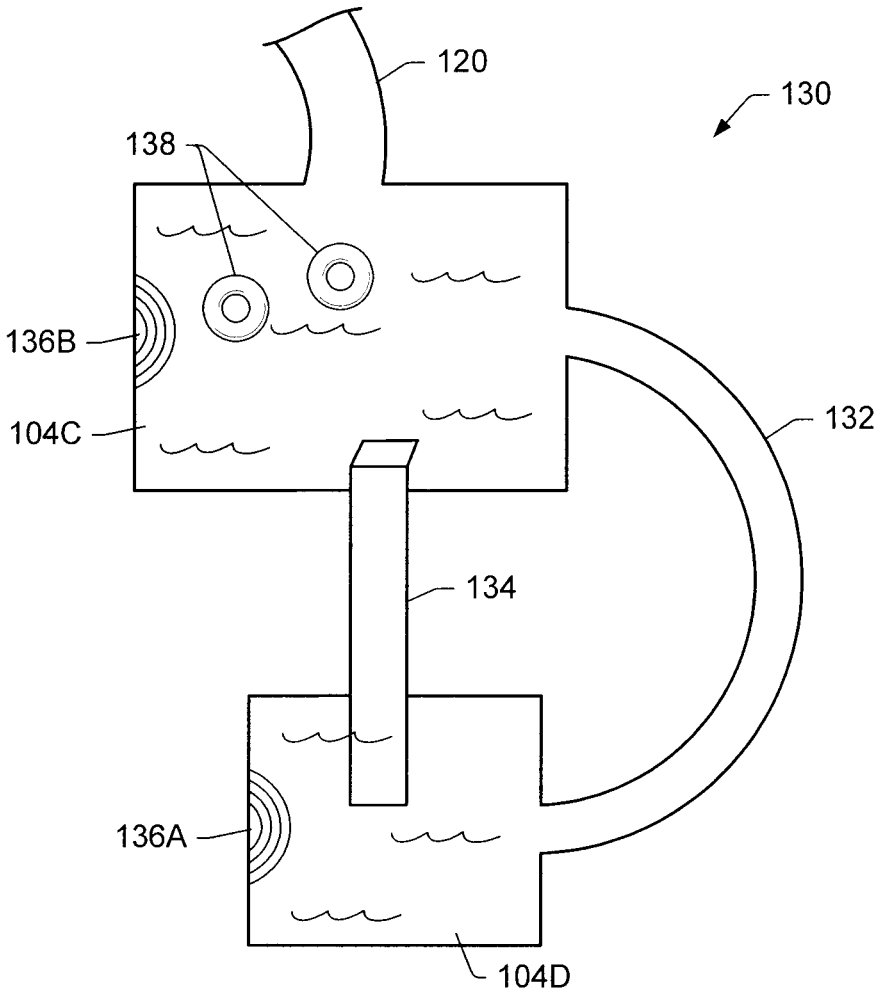
FIG. 8 depicts an embodiment of a portion of a continuous water slide.

FIG. 8 depicts an embodiment of a portion of continuous water ride 130. Continuous water ride 130 may include body of water 104C. Body of water 104C may be coupled to downhill water slide 132. Downhill water slide 132 may couple body of water 104C to body of water 104D. Body of water 104D may be positioned at a lower elevation than body of water 104C. Body of water 104D may include access point 136A. Access point 136A may allow participants to safely enter and/or exit body of water 104D. As depicted in FIG. 8 access points 136 may be stairs. Access points 136 may also include ladders and/or a gradually sloping walkway. Body of water 104D may be coupled to body of water 104C with elevation system 134. Elevation system 134 as depicted in FIG. 8 is a conveyor belt system. Elevation system 134 may be at least any system of elevation described herein. Body of water 104C may be coupled to a second water ride. The second water ride may be, for example, lazy river 120.

FIG. 8 depicts one small example of continuous water ride 130. Continuous water ride 130 may allow participants and/or their vehicles 138 (e.g., inner tubes) to ride continually without having to leave their vehicle. For example a participant may enter body of water 104C through access point 136B. The participant may ride vehicle 138 down downhill water slide 132 to body of water 104D. At this point the participant has the choice to exit body of water 104D at access point 136A or to ride their vehicle 138 up elevation system 134 to body of water 104C. For safety reasons one or both ends of elevation system 134 may extend below the surface of bodies of water 104. Extending the ends of elevation system 134 below the surface of the water may allow participants to float up on elevation system 134 more safely. Participants who choose to ride elevation system 134 to body of water 104C may then choose to either exit access point 136B, ride downhill water slide 132 again, or ride lazy river 120.

In some embodiments, bodies of water 104 may include multiple elevation systems 134 and multiple water rides connecting each other. In some embodiments, floating queue lines and/or channels may couple water rides and elevation systems. Floating queue lines may help control the flow of participants more efficiently than without using floating queue lines.

Figure 9:
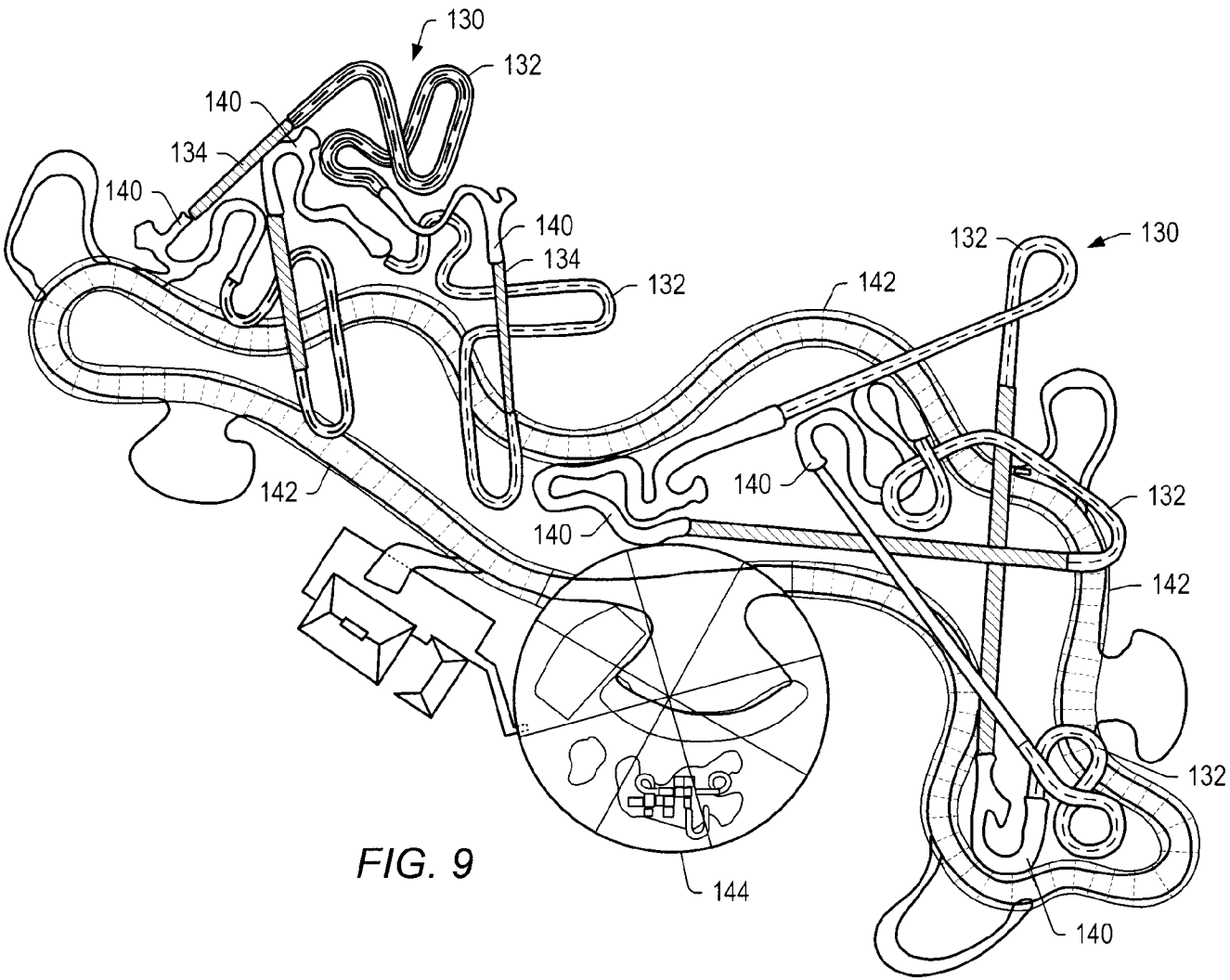
FIG. 9 depicts an embodiment of a water park.

FIG. 9 depicts an embodiment of a water amusement park. Water amusement park 118 depicted in FIG. 9 shows several different examples of continuous water rides 130. Continuous water rides 130 may include elevation systems 134, downhill water slide 132, and floating queue systems 140. Elevation systems 134 may include, for example, conveyor belt systems as depicted in FIG. 9. Downhill water slides 132 may couple elevation systems 134 to floating queue systems 140.

In some embodiments, elevation systems may include a conveyor belt system. Conveyor belt systems may be more fully described in U.S. Patent Publication No. 20020082097 to Henry et al., which is incorporated by reference as if fully set forth herein. This system may include a conveyor belt system positioned to allow riders to naturally float up or swim up onto the conveyor and be carried up and deposited at a higher level.

The conveyor belt system may also be used to take riders and vehicles out of the water flow at stations requiring entry and/or exit from the continuous water ride. Riders and vehicles float to and are carried up on a moving conveyor on which riders may exit the vehicles. New riders may enter the vehicles and be transported into the continuous water ride at a desired location and velocity. The conveyor may extend below the surface of the water so as to more easily allow riders to naturally float or swim up onto the conveyor. Extending the conveyor below the surface of the water may allow for a smoother entry into the water when exiting the conveyor belt. Typically the conveyor belt takes riders and vehicles from a lower elevation to a higher elevation, however it may be important to first transport the riders to an elevation higher than the elevation of their final destination. Upon reaching this apex the riders then may be transported down to the elevation of their final destination on a water slide, rollers, or on a continuation of the original conveyor that transported them to the apex. This serves the purpose of using gravity to push the rider off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing water may move the riders away from the conveyor endpoint in a quick and orderly fashion so as not to cause increase in rider density at the conveyor endpoint. Further, moving the riders quickly away from the conveyor endpoint may act as a safety feature reducing the risk of riders becoming entangled in any part of the conveyor belt or its mechanisms. A deflector plate may also extend from one or more ends of the conveyor and may extend to the bottom of the channel. When the deflector plate extends at an angle away from the conveyor it may help to guide the riders up onto the conveyor belt as well as inhibit access to the rotating rollers underneath the conveyor. These conveyors may be designed to lift riders from one level to a higher one, or may be designed to lift riders and vehicles out of the water, onto a horizontal moving platform and then return the vehicle with a new rider to the water.

The conveyor belt speed may also be adjusted in accordance with several variables. The belt speed may be adjusted depending on the rider density; for example, the speed may be increased when rider density is high to reduce rider waiting time. The speed of the belt may be varied to match the velocity of the water, reducing changes in velocity experienced by the rider moving from one medium to another (for example from a current of water to a conveyor belt). Decreasing changes in velocity is an important safety consideration due to the fact that extreme changes in velocity may cause a rider to become unbalanced. Conveyor belt speed may be adjusted so riders are discharged at predetermined intervals, which may be important where riders are launched from a conveyor to a water ride that requires safety intervals between the riders.

Several safety concerns should be addressed in connection with the conveyor system. The actual belt of the system should be made of a material and designed to provide good traction to riders and vehicles without proving uncomfortable to the riders touch. The angle at which the conveyor is disposed is an important safety consideration and should be small enough so as not to cause the riders to become unbalanced or to slide in an uncontrolled manner along the conveyor belt. Detection devices or sensors for safety purposes may also be installed at various points along the conveyor belt system. These detection devices may function to determine if any rider on the conveyor is standing or otherwise violating safety parameters. Gates may also be installed at the top or bottom of a conveyor, arranged mechanically or with sensors wherein the conveyor stops when the rider collides with the gate so there is no danger of the rider being caught in and pulled under the conveyor. Runners may cover the outside edges of the conveyor belt covering the space between the conveyor and the outside wall of the conveyor so that no part of a rider may be caught in this space. All hardware (electrical, mechanical, and otherwise) should be able to withstand exposure to water, sunlight, and various chemicals associated with water treatment (including chlorine or fluorine) as well as common chemicals associated with the riders themselves (such as the various components making up sunscreen or cosmetics).

Various sensors may also be installed along the conveyor belt system to monitor the number of people using the system in addition to their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the riders. Some or all of these adjustments may be automated and controlled by a programmable logic control system.

Various embodiments of the conveyor lift station include widths allowing only one or several riders side by side to ride on the conveyor according to ride and capacity requirements. The conveyor may also include entry and exit lanes in the incoming and outgoing stream so as to better position riders onto the conveyor belt and into the outgoing stream.

Figure 10:
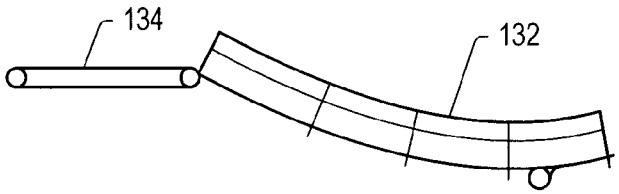
FIG. 10 depicts a side view of an embodiment of a conveyor lift station coupled to a water ride.
Figure 11:
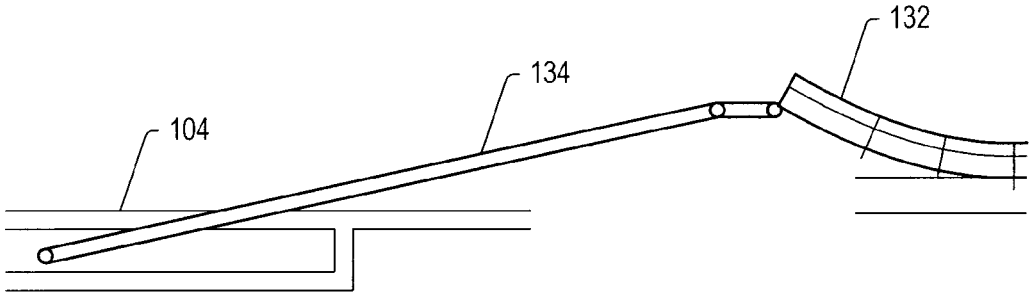
FIG. 11 depicts a side view of an embodiment of a conveyor lift station with an entry conveyor coupled to a water slide.
Figure 12:
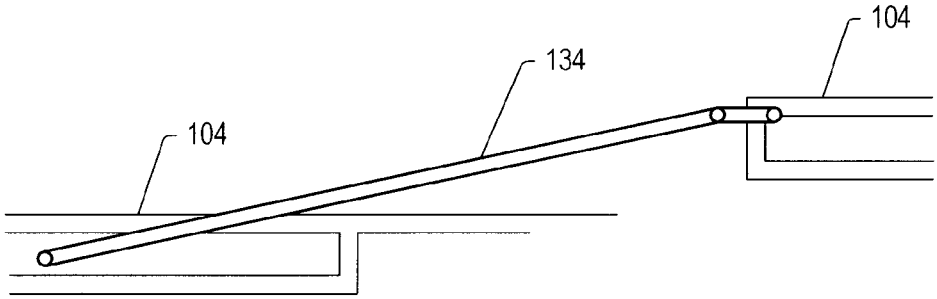
FIG. 12 depicts a side view of an embodiment of a conveyor lift station coupled to an upper channel.

More embodiments of conveyor systems are shown in FIGS. 10-12. FIG. 10 shows a dry conveyor for transporting riders entering the system into a channel. It includes a conveyor belt portion ending at the top of downhill slide 132 which riders slide down on into the water. FIG. 11 shows a wet conveyor for transporting riders from a lower channel to a higher one with downhill slide 132 substituted for the launch conveyor. FIG. 12 shows a river conveyor for transporting riders from a channel to a lazy river. This embodiment does not have a descending portion.

In some embodiments, an elevation system may include a water lock system. These systems may be used to increase elevation and/or decrease elevation. In certain embodiments, an exit point of a first water ride of a continuous water ride may have an elevation below an entry point of a second water ride of the continuous water ride. In some embodiments, the water lock system includes a chamber for holding water coupled to the exit point of the first water ride and the entry point of the second water ride. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in certain embodiments, extends below an upper surface of the first water ride and above the upper surface of the second water ride. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the exit point of the first water ride and the chamber when the first movable member is open during use. A second movable member may be formed in the wall of the chamber. The second movable member may be positioned to allow participants and water to move between the entry point of the second water ride and the chamber when the second movable member is open during use. The second movable member may be formed in the wall at an elevation that differs from that of the first movable member.

In certain embodiments, the first and second movable members may be configured to swing away from the chamber wall when moving from a closed position to an open position during use. In certain embodiments, the first and second movable members may be configured to move vertically into a portion of the wall when moving from a closed position to an open position. In certain embodiments, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In certain embodiments, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate water jets to direct and/or propel participants in or out of the chamber.

Water lock systems are more fully described in U.S. Patent Publication No. 20020082097.

In some embodiments, elevation systems may not be mere systems of conveyance to different elevation levels. Elevations systems may be designed to be entertaining and an enjoyable part of the water ride as well as the water rides of the continuous water ride which the elevation system is connecting. For example, when the elevation system includes an uphill water slide, the entertainment value may be no less for the elevation system of the continuous water ride than for the connected water rides.

In some embodiments, an exit point of a second water ride of a continuous water ride may be coupled to an entry point of a first water ride. Coupling the exit point of the second water ride to the entry point of the first water ride may form a true continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines are more fully described in U.S. Patent Publication No. 20020082097. Floating queue lines may assist in coupling different portions of a continuous water ride. Floating queue line systems may be used for positioning riders in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position within a station.

In use, riders desiring to participate on a water ride may leave the body of water and enter the floating queue line. The floating queue line may include pump inlets and outlets similar to those in a horizontal channel but configured to operate intermittently to propel riders along the queue line, or the inlet and outlet may be used solely to keep a desired amount of water in the queue line. In the latter case, the channel may be configured with high velocity low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the rider enters the ride to which the queue line delivers them, or by out-flowing the water down a bottom slope that starts after the point that the rider enters the ride. In certain embodiments, the water moves through the queue channel by means of a sloping floor. The water from the outflow of the queue line, in any method, can reenter the main channel, another ride or water feature, or return to the system sump. Preferably the water level and width of the queue line are minimized for water depth safety, rider control, and water velocity. These factors combined deliver the participants to the ride in an orderly and safe fashion, at the preferred speed, with minimal water volume usage. The preferred water depth, channel width and velocity would be set by adjustable parameters depending on the type of riding vehicle, participant comfort and safety, and water usage. Decreased water depth may also be influenced by local ordinances that determine level of operator or lifeguard assistance, the preferred being a need for minimal operator assistance consistent with safety.

In some embodiments, continuous water rides may include exits or entry points at different portion of the continuous water ride. Floating queue lines coupling different portions and/or rides forming a continuous water ride may include exit and/or entry points onto the continuous water ride. Exit/entry points may be used for emergency purposes in case of, for example, an unscheduled shutdown of the continuous water ride. Exit/entry points may allow participants to enter/exit the continuous water ride at various designated points along the ride during normal use of the continuous water ride. Participants entering/exiting the continuous water ride during normal use of the ride may not disrupt the normal flow of the ride depending on where the entry/exit points are situated along the course of the ride.

Embodiments disclosed herein provide an interactive control system for a continuous water ride and/or portions of the continuous water ride. In certain embodiments, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In some embodiments, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, a participant identifier and/or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to active a water system, sound system, and/or light system in response to a detection signal indicating that a participant is proximate to an activation point. The control system may also be coupled to flow control devices, such as, but not limited to: valves, and pumps. Valves may include air valves and water valves configured to control the flow of air and water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Throughout the system electronic signs or monitors may be positioned to notify riders or operators of various aspect of the system including, but not limited to: operational status of any part of the system described herein above; estimated waiting time for a particular ride; and possible detours around non operational rides or areas of high rider density.

In some embodiments, a water amusement park and/or a floating marine park may include a cover or a screen. Screens may be used to substantially envelope or cover a portion of a water amusement park. Portions of the screen may be positionable. Screens may be used to form a convertible roof. Positionable screen portions may allow portions of the park to be covered or uncovered. The decision to cover or uncover a portion of the water amusement park may be based on the weather. Inclement weather may prompt operators to cover portions of the water park with the positionable screens. While clear warm weather may allow operators to move the positionable screen so portions of the water amusement park remain uncovered.

In some embodiments, one or more convertible roofs may function to substantially cover at least a portion of one or more of the floating containers forming a floating marine park. One or more convertible roofs may function to substantially enclose at least a portion of one or more of the floating containers. At least a portion of at least one of the screens may be retractable, and wherein when at least a portion of the screen is in a retracted position at least a portion of one or more of the floating containers is uncovered.

In some embodiments, positionable screens may be formed from substantially translucent materials. Translucent materials may allow a portion of the visible light spectrum to pass through the positionable screens. Translucent materials may inhibit transmittance of certain potentially harmful portions of the light spectrum (e.g., ultraviolet light). Filtering out a potentially harmful portion of the light spectrum may provide added health benefits to the water amusement park relative to uncovered water amusement parks. A non-limiting example of possible screen material may include Foiltech. Foiltech has an R protective value of about 2.5. A non-limiting example of possible screen material may include polycarbonates. Polycarbonates may have an R protective value of about 2. In some embodiments, multiple layers of screen material (e.g., polycarbonate) may be used. Using multiple layers of screen material may increase a screen materials natural thermal insulating abilities among other things. Portions of the screening system described herein may be purchased commercially at Arqualand in the United Kingdom.

In some embodiments, portions of the positionable screen may assist in collecting solar radiation. Solar radiation collected by portions of the positionable screen may be used to increase the ambient temperature in the area enclosed by the screen. Increasing the ambient temperature in enclosed portions of the water amusement park using collected solar radiation may allow the water amusement park to remain open to the public even when the outside temperature is uncomfortably cold and unconducive to typical outside activities.

In some embodiments, positionable screens may be used to enclose portions of a water amusement park. Enclosed areas of the water amusement park may function as a heat sink. Heat emanating from bodies of water within the enclosed area of the water amusement park may be captured within the area between the body of water and the positionable screens. Heat captured under the positionable screens may be recirculated back into the water. Captured heat may be recirculated back into the water using heat pumps and/or other common methods known to one skilled in the art.

In some embodiments, screens may be mounted on wheels and/or rollers. Screens may be formed from relatively light but strong materials. For example, panels may be formed from polycarbonate for other reasons described herein, while structural frameworks supporting these panels may be formed from, for example, aluminum. Lightweight, well-balanced, support structures on wheels/rollers might allow screens to be moved manually by only a few operators. Operators might simply push screens into position. Mechanisms may be installed to assist operators in manually positioning screens (e.g., tracks, pulley mechanisms).

In some embodiments, a portion of a screen may be formed from a plurality of panels. Panels of a screen may be individually positionable such that one or more individual panels may be removed as desired or rolled back or swung open depending on how the panels are secured (e.g., hinges, tracks).

Examples of systems which facilitate movement of screens over bodies of water and/or channels (e.g., track based systems) are illustrated in U.S. Pat. No. 4,683,686 to Ozdemir and U.S. Pat. No. 5,950,253 to Last, each of which is incorporated by reference as if fully set forth herein.

In some positionable screen embodiments, screens may be moved using automated means. Powered engines (e.g., electrically driven) may be used to move positionable screens around using central control systems. Control systems may be automated to respond to input from sensors designed to track local weather conditions. For example, sensors may detect when it is raining and/or the temperature. When it begins to rain and/or the temperature drops below a preset limit an automated control system may move positionable screen to enclose previously unenclosed portions of the water amusement park.

In some embodiments, screens may be mounted to a fixed skeletal structure. The fixed skeletal structure may not move. The screens mounted to the fixed skeletal structure may be positionable along portions of the fixed skeletal structure. For example portions of a screen may be mounted on tracks positioned in the fixed skeletal structure. Tracks may allow the portions of the screens to move up, down, and/or laterally. Positionable portions of screens mounted in a fixed skeletal structure may provide an alternative for opening/enclosing a portion of a water park. In certain embodiments, the two concepts may be combined whereby portions of, for example, screen 142A (as depicted in FIG. 13) are positionable within a skeletal structure of screen 142A.

Figure 13:
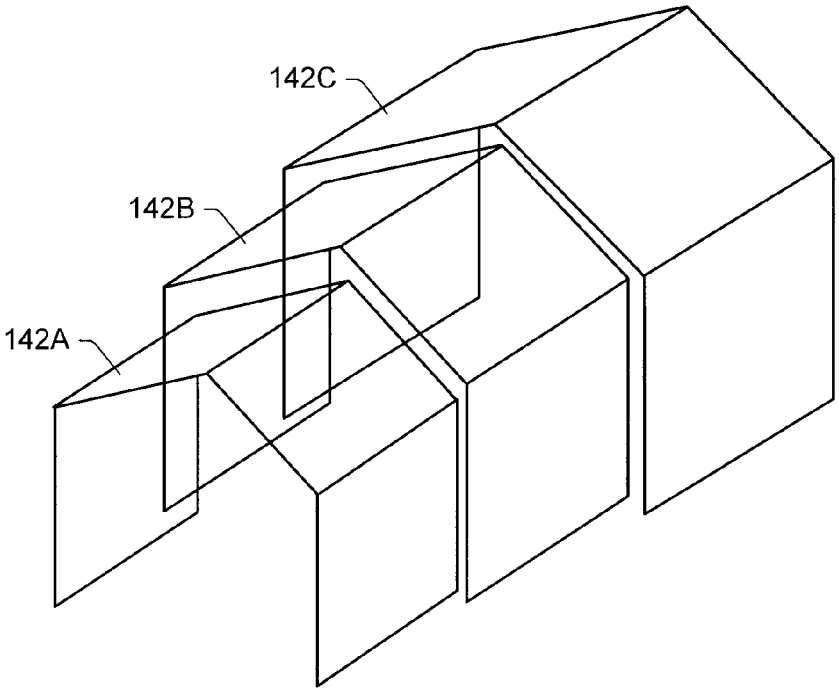
FIG. 13 depicts an embodiment of a positionable screen for a convertible water park.
Figure 14:
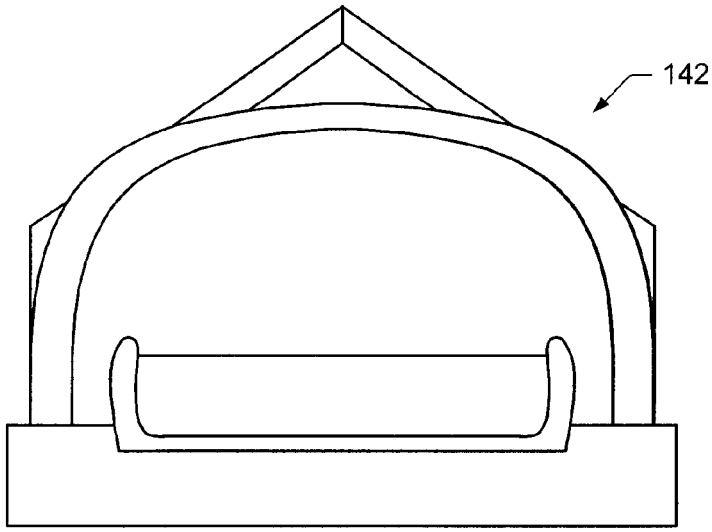
FIG. 14 depicts an embodiment of a positionable screen for a convertible water park.

FIG. 13 depicts an embodiment of a portion of a positionable screen system for use in a water amusement park. Screens 142A-C may be successively smaller. Making screens 142A-C successively smaller may allow the screens to be retracted within one another in a "stacked" configuration when not in use. During use (e.g., during inclement weather) screens 142A-C may be pulled out from under one another extending the screens over a portion of a water park (e.g., a river or channel) to protect participants from the elements. FIG. 14 depicts a cross-sectional view of an embodiment of a portion of a positionable screen system over a body of water. Screens 142A-C may include stops to ensure that when the screens are extended there is always a small overlap between the screens. Screens 142A-C may include seals to close the gaps between the screens when the screens are extended. In this way the portion of the water park is substantially enclosed within screens 142A-C. Screens 142A-C may be at least high enough to inhibit participants from colliding with the ceiling of the screens.

In a water amusement park embodiment depicted in FIG. 14, screens 142 have been extended over a portion of a channel or river. The channel connects different portions of a convertible water amusement park. In some embodiments, a channel (e.g., a river) including positionable screens may connect separate water amusement parks. Connecting separate water parks with screened channels may allow a participant to travel between water parks without leaving the water even during inclement weather. Screens 142 allow for the use of the convertible water amusement park during inclement weather. Screens 142 may allow participants to travel between enclosed water park amusement area 144 and continuous water rides 130 as depicted in FIG. 9. Water park amusement area 144 may include food areas, games, water amusement games, water rides and/or any other popular forms of entertainment.

In some embodiments, screens form a convertible cover, i.e. in which panels forming the cover can slide relative to one another. Some sections, adapted for such structures, may include side grooves. Side grooves may facilitate positioning of the panels allowing the panels to slide relative to each other. In some embodiments, the convertible covers or screens may include curved arches forming the overall structure.

In some embodiments, sections of the framework forming a convertible cover or positionble screen may include frameworks known to one skilled in the art as relates to covers for swimming pools and/or greenhouses. For example, the framework may include substantially tubular metal frames. Portions of the tubular metal frames may include interior reinforcement members. Interior reinforcement members may strengthen the tubular metal frames. Interior reinforcement members may include a hollow rectangular section positioned in the tubular metal frames.

In some embodiments, sections of the framework forming the positionable screens may be formed in the overall shape of an arch. Sections may include one or more tracks positioned on one or more sides of the framework. The tracks may allow panels (i.e., portions of a screen) to slide along the sections of the framework relative to one another.

In some embodiments, screens may have several rigid frame members. The number may depend upon the length of the area being covered. Each frame member may include a plurality of sections which are connected together in an end-to-end relationship. Sections may be any shape (e.g., rectangular, square, triangular). The connection between frame member sections may be by means known to one skilled in the art (e.g., bolts, hinges). Hinges may allow at least a portion of the structure to be folded if it is desired to remove the screen completely. Each of the rigid frame members may include a pair of oppositely disposed substantially vertical wall sections and ceiling sections joined together in an arch. Between the rigid frame members are panels of flexible material which may include canvas or other easily foldable material. End panels may also be formed of a foldable material which is preferably transparent or translucent.

In certain embodiments, a ceiling section may include a pair of parallel, longitudinally extending, channel-shaped side elements and a pair of channel-shaped end elements. The side flanges of each of the four elements forming the section extend inwardly. The side and end elements may be welded together or they may be held together by means of suitable fasteners to form a rectangular frame section. Attached to the outer (upper) side flanges of the elements are spacers which extend around the periphery of the structure. Outwardly of the spacers and coextensive with the side elements are a pair of upwardly extending smaller channel elements which are of greater width than the spacer and thus protrude inwardly over and are spaced from the top web of the larger side elements. This spacing will accommodate a rigid panel of transparent or translucent material such as plexiglass. Around the panel may be a resilient bead of flexible material which serves as a weather seal for the panel. Bolts may be used to connect the end element of a frame section to the opposite end element of the next adjacent frame section. If desired, braces may be bolted to the sides of the frame member sections for added rigidity and strength at the joint.

In some embodiments, extending along the sides of the body of water may be a pair of spaced, parallel, channel-shaped track members. The track members may be identical in construction. The track member may have a base, sides, and top flanges. Top flanges close a part of the channel-shaped track member leaving only the longitudinal slot-like opening visible from the top of the track. The tracks may extend well beyond one end of the body of water so that the screen may be stored at that end. For drainage as well as assembly purposes, it may be desirable that at least one end of the track be open. The track may be suitably anchored by conventional screw anchors or the like (not shown).

In some embodiments, attached to the lower ends of each of the frame member wall portions are guide means which extend into the interior of a respective one of the channel-shaped track members for engaging the interior of the track members. Guide means allow that the frame members may be guided along the track members toward and away from one another to selectively cover and uncover the body of water between the track members.

In certain embodiments, a wall panel of a screen as well as the entire rigid frame structure may be clamped in the desired position of adjustment with respect to the track.

In certain embodiments, there may be a laterally stabilizing roller for engaging the side walls of the channel track. This roller also serves as part of the guide means to guide the frame member along the track keeping it in longitudinal alignment.

In some embodiments, for purposes of stability and smooth rolling action there may be provided a horizontal roller and a vertical roller at each end of the wall panels of the screen. Thus each of the wall panels will have a pair of vertical rollers and a pair of horizontal rollers.

In some embodiments, each of the frame members may have a pair of spaced, parallel, transverse portions. The end elements and the panel maintain the spacing of the side elements and the rigidity of the frame members. The bottom element of the wall sections may flatly engage the top of the track over a substantial longitudinal distance. This provides a solid locked-in-place stability for the frame member and there is little tendency for the frame members to skew or otherwise become misaligned. The provision of the rollers at either end of the wall panel provide stability during movement of the frame member.

In some embodiments, the end element of frame members meet at obtuse angles. A wedge-like spacer may be placed between the end elements of the adjacent sections. The spacer may be tapered in accordance with the angle at which the two sections are to be joined. The spacer may be apertured or slotted to accommodate the bolts which are used to connect the end elements together.

In some embodiments, the roller carriage acts as the clamp for clamping the frame members in position, however it is not essential that this carriage double as a clamp. The roller carriage may be fixed in place and it could carry not only the horizontal roller but also the vertical roller. Other locking means could be provided for clamping the base plate and the end element of the wall section in flat position against the top of the channel track.

In certain embodiments, only short particular sections covering the body of water or channel may be rigid. A series of short rigid sections as described herein may be coupled together by stretches of flexible material. The sections of flexible material may be much longer relative to the supporting short rigid sections. The flexible material may allow the screen to be collapsed at those points as the screens are repositioned and retracted. The flexible material may be translucent much like the panels making up the rigid sections of the screen.

In some embodiments, some water amusement park areas may include immovable screens substantially enclosing the water amusement area (e.g., a dome structure). While other water amusement areas may remain uncovered year round. Channels may connect different water amusement areas. Channels may include portions of a natural river. Channels may include portions of man-made rivers or reservoirs. Channels may include portions of a natural or man-made body of water (e.g., a lake). The portions of the natural or man-made body of water may include artificial or natural barriers to form a portion of the channel in the body of water. Channels may include positionable screens as described herein. In some embodiments, an entire water park may include permanent and/or positionable screens covering the water park. In some embodiments, only portions of a water park may include permanent and/or positionable screens.

There are advantages to covering the channels and/or portions of the park connected by the channels as opposed to covering the entire park in, for example, one large dome. One advantage may be financial, wherein enclosing small portions and/or channels of a park is far easier from an engineering standpoint and subsequently much cheaper than building a large dome. Channels that extend for relatively long distances may be covered far more easily than a large dome structure extending over the same distance which covers the channel and much of the surrounding area. It is also far easier to retract portions of the screens described herein to selectively expose portions of a water park than it is to selectively retract portions of a dome.

Screen systems may be more fully described in U.S. Patent Publication No. 20050090318 to Henry et al., which is incorporated by reference as if fully set forth herein.

In some embodiments, screens may be substantially static. Screen may not be mounted on tracks. Portions of a water park may be permanently covered. In some embodiments, screens or portions of screens may be formed from flexible substantially transparent materials. Screen materials may include sheets of flexible polymers. In some embodiments, screens may include tents formed from substantially translucent polymer sheets which may be easily erected and disassembled as desired. Materials such as these may decrease materials and construction costs relative to more rigid transparent polycarbonate screens. Flexible polymer screens may also require less labor to remove. Portions of a flexible polymer screen may be rolled back to expose the water park beneath.

In some embodiments, portions of a screen include a theme. Themed portions may or may not include transparent materials. Themes may include a jungle or tropical environment. Theme elements may include screens built to resemble palapas. Theme elements may include sound elements (e.g., jungle animal noises, rain, thunder, lightning). Theme elements may include light elements (e.g., lightning).

Figure 15:
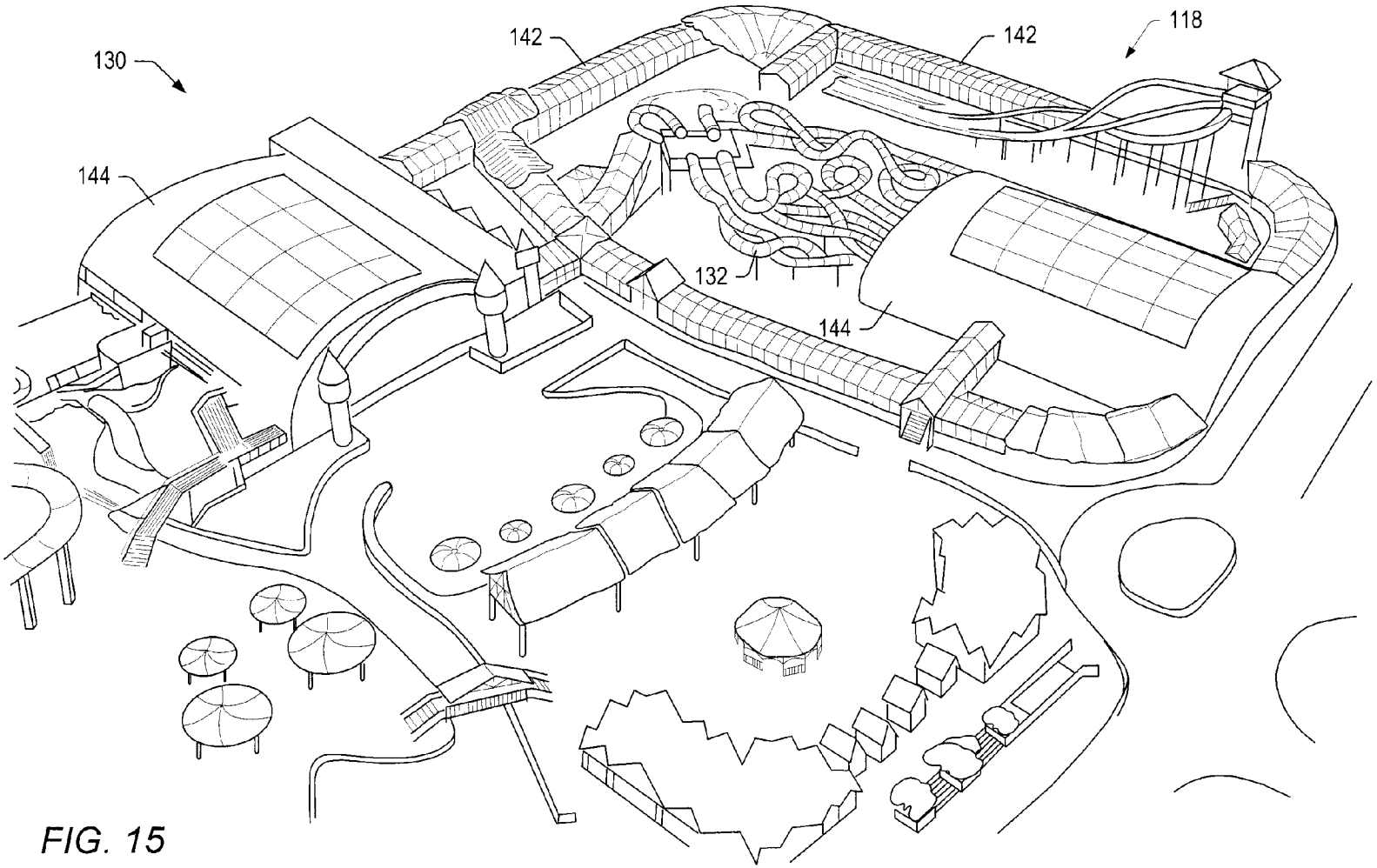
FIG. 15 depicts an embodiment of a water park including screens.
Figure 16:
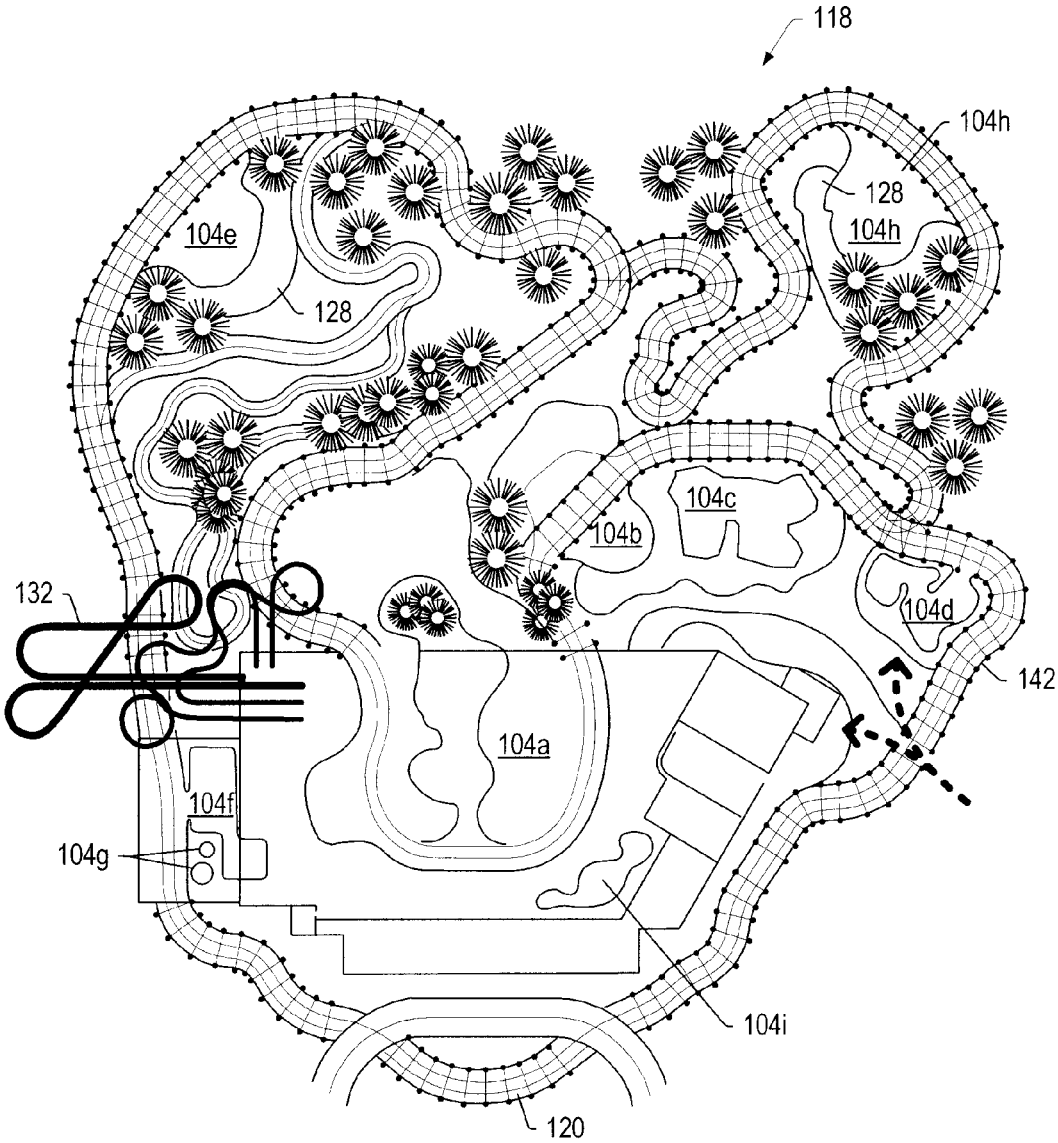
FIG. 16 depicts an embodiment of a water park including screens.

FIGS. 15 and 16 depict embodiments of a water amusement park including screens. Water amusement park 118 depicted in FIGS. 15 and 16 shows several different examples of continuous water rides 130.

In some embodiments, a channel (e.g., a river) including positionable screens may connect separate water amusement parks. Connecting separate water parks with screened channels may allow a participant to travel between water parks without leaving the water even during inclement weather. Screens 142 allow for the use of the convertible water amusement park during inclement weather. Screens 142 may allow participants to travel between enclosed water park amusement area 144 and continuous water rides 130 as depicted in FIG. 9. Water park amusement area 144 may include food areas, games, water amusement games, water rides and/or any other popular forms of entertainment.

Continuous water rides 130 may include elevation systems 134, downhill water slide 132, and floating queue systems 140. Elevation systems 134 may include, for example, conveyor belt systems as depicted in FIG. 9. Downhill water slides 132 may couple elevation systems 134 to floating queue systems 140.

FIG. 16 depict embodiments of water amusement park 118 including screens. The water amusement park depicted in FIG. 16 may include at least some elements of a marine park. Covered lazy river 120 may connect different portions of a marine water park including, but not limited to, bodies of water 104*a-i*. Different bodies of water may serve different functions. In some embodiments, a body of water may serve multiple functions. A body of water may serve one function one season and a different function during a different season.

Bodies of water 104*b* and 104*d* may include activity pools. In some embodiments, bodies of water 104*b* and 104*d* may resemble more traditional pools known to one skilled in the art. Body of water 104*c* may include a children's pool. A children's wade pool may be very shallow decreasing the likelihood of accidental drownings. In some embodiments, a children's pool may be 2-4 feet in depth. In some embodiments, a children's pool may be 1-3 feet in depth. Body of water 104*f* may include an exercise pool. An exercise pool may provide a more adult setting for adults (e.g., parents of children attending the park) to exercise. An exercise pool may include special equipment and/or instructors and exercise classes. Bodies of water 104*g* may include hot tubs. Body of water 104*i* may include a toddler's pool. A toddler's wade pool may be very shallow decreasing the likelihood of accidental drownings. In some embodiments, a toddler's pool may be 1-2 feet in depth. In some embodiments, a toddler's pool may be 0.5-1 feet in depth.

Bodies of water 104*e* and 104*h* may include a zero-entry beach access 128. In some embodiments, bodies of water 104*e* and 104*h* may more closely emulate a natural body of water such as a lake or bay of an ocean to provide participants with a more natural experience.

In some embodiments, water amusement parks may include participant identifiers. Participant identifiers may be used to locate and/or identify one or more participants at least inside the confines of the water amusement park. Participant identifiers may assist control systems in the water amusement park. Participant identifiers may be considered as one portion of a water amusement park control system in some embodiments. Participant identifiers may be used for a variety of functions in the water amusement park.

In some embodiments, a plurality of personal identifiers may be used in combination with a water amusement park. Personal identifiers may be provided to each individual participant of the water amusement park. Personal identifiers may be provided for each member of staff working at the water amusement park. Within the context of this application the term "participant" may include anyone located in the confines of the water amusement park including, but not limited to, staff and/or patrons. A plurality of sensors may be used in combination with the personal identifiers. Personal identifiers may function as personal transmitters. Sensors may function as receiver units. Sensors may be positioned throughout the water amusement park. Sensors may be positioned, for example, at particular junctions (i.e., coupling points) along, for example, a continuous water ride. Sensors may be placed along, for example, floating queue lines, channels, entry/exit points along water rides, and/or entry/exit points between portions of the water amusement park. Personal identifiers working in combination with sensors may be used to locate and/or identify participants.

In some embodiments, personal identifiers and/or sensors may be adapted for ultrasonic, or alternatively, for radio frequency transmission. Personal identifiers and/or sensors may operate on the same frequency. Identification of individual personal identifiers may be achieved by a pulse timing technique whereby discrete time slots are assigned for pulsing by individual units on a recurring basis. Pulses received from sensors may be transmitted to decoder logic which identifies the locations of the various transmitter units in accordance with the time interval in which pulses are received from various sensors throughout the water amusement park. A status board or other display device may display the location and/or identity of the participant in the water amusement park. Status of a participant may be displayed in a number of ways. Status of a participant may be displayed as some type of icon on a multi-dimensional map. Status of a participant may be displayed as part of a chart displaying throughput for a portion of the water amusement park.

In some embodiments, programming means may be provided for a participant identifier. Participant identifiers may be substantially identical in construction and electronic adjustment. Participant identifiers may be programmed to predetermined pulse timing slots by the programming means. Any participant may use any participant identifier. The particular pulse timing slot may be identified as corresponding with a particular participant using a programmer Participant identifiers may be associated with a particular participant by positioning the participant identifier in a receptacle. The receptacle may be coupled to the programmer Receptacles may function to recharge a power source powering the participant identifier. In some embodiments, a receptacle may not be necessary and the personal identifier may be associated in the water amusement park with a particular participant via wireless communication between the personal identifier and a programmer.

In some embodiments, participant identifiers may be removably coupled to a participant. The participant identifier may include a band which may be coupled around an appendage of a participant. The band may be attached around, for example, an arm and/or leg of a participant. In some embodiments, identifiers may include any shape. Identifiers may be worn around the neck of a participant much like a medallion. In some embodiments, an identifier may be substantially attached directly to the skin of a participant using an appropriate adhesive. In some embodiments, an identifier may be coupled to an article of clothing worn by a participant. The identifier may be coupled to the article of clothing using, for example, a "safety pin", a plastic clip, a spring clip, and/or a magnetic based clip. In some embodiments, identifiers may be essentially "locked" after coupling the identifier to a participant. A lock may inhibit the identifier from being removed from the participant by anyone other than a staff member except under emergency circumstances. Locking the identifier to the participant may inhibit loss of identifiers during normal use of identifiers. In some embodiments, a participant identifier may be designed to detach form a participant under certain conditions. Conditions may include, for example, when abnormal forces are exerted on the participant identifier. Abnormal forces may result from the participant identifier becoming caught on a protrusion, which could potentially endanger the participant.

In some embodiments, circuitry and/or a power source may be positioned substantially in the personal identifiers. Positioning any delicate electronics in the personal identifier, such that material forming the personal identifier substantially envelopes the electronics, may protect sensitive portions of the personal identifier from water and/or corrosive chemicals typically associated with a water amusement park. Participant identifiers may be formed from any appropriate material. Appropriate materials may include materials that are resistant to water and corrosive chemicals typically associated with a water amusement park. Participant identifiers may be at least partially formed from materials which are not typically thought of as resistant to water and/or chemicals, however, in some embodiments materials such as these may be treated with anticorrosive coatings. In certain embodiments, participant identifiers may be formed at least partially from polymers.

In some embodiments, a personal identifier may be brightly colored. Bright colors may allow the identifier to be more readily identified and/or spotted. For example, if the identifier becomes decoupled from a participant the identifier may be more easily spotted if the identifier is several feet or more under water. In some embodiments, a personal identifier may include a fluorescent dye. The dye may be embedded in a portion of the personal identifier. The dye may further assist in spotting a lost personal identifier under water and/or under low light level conditions (e.g., in a covered water slide).

Figure 17:
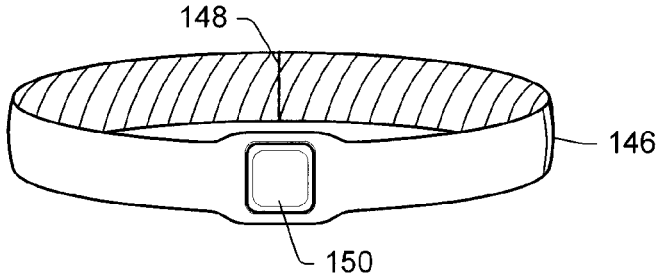
FIG. 17 depicts an embodiment of a participant identifier.

FIG. 17 depicts an embodiment of a participant identifier. Participant identifier 146 may be a wrist band as depicted in FIG. 17. Participant identifier 146 may include locking mechanism 148. Locking mechanism 148 may be positioned internally in participant identifier 146 as depicted in FIG. 17. Locking mechanism 148 may function so that only water park operators can remove participant identifier 146. This may reduce the chance of participant identifier 146 being lost. Participant identifier 146 may include interactive point 150. Interactive point 150 may be a display screen, a touch screen, and/or a button. Interactive point 150 may allow a participant to send a signal with participant identifier 146 so as to activate and/or interact with a portion of an amusement park (e.g., an interactive game). Interactive point 150 may display relevant data to the participant (e.g., time until closing of the park, amount of electronic money stored on the wrist band, and/or participant location in the water park).

Other components which may be incorporated into a participant identifier system are disclosed in the following U.S. patents, herein incorporated by reference: a personal locator and display system as disclosed in U.S. Pat. No. 4,225,953; a personal locator system for determining the location of a locator unit as disclosed in U.S. Pat. No. 6,362,778; a low power child locator system as disclosed in U.S. Pat. No. 6,075,442; a radio frequency identification device as disclosed in U.S. Pat. No. 6,265,977; and a remote monitoring system as disclosed in U.S. Pat. No. 6,553,336.

In some embodiments, participant identifiers may be used as part of an automated safety control system. Participant identifiers may be used to assist in determining and/or assessing whether a participant has been separated from their vehicle. Sensors may be positioned along portions of a water amusement park. For example sensors may be placed at different intervals along a water amusement ride. Intervals at which sensors are placed may be regular or irregular. Placement of sensors may be based on possible risk of a portion of a water amusement ride. For example, sensors may be placed with more frequency along faster moving portions of a water amusement ride where the danger for a participant to be separated from their vehicle is more prevalent.

In some embodiments, vehicle identifiers may be used to identify a vehicle in a water amusement park. The vehicle identifier may be used to identify the location of the vehicle. The vehicle identifier may be used to identify the type of vehicle. For example, the vehicle identifier may be used to identify how many people may safely ride in the vehicle.

In some embodiments, sensors near an entry point of a portion of a water amusement ride may automatically assess a number of participant identifiers/participants associated with a particular vehicle. Data such as this may be used to assess whether a participant has been separated from their vehicle in another portion of the water amusement ride.

In some embodiments, an operator may manually input data into a control system. Data input may include associating particular participant identifier(s) and/or the number of participants with a vehicle.

In some embodiments, a combination of automated and manual operation of a safety control system may be used to initially assess a number of participants associated with a vehicle. For example, an operator may provide input to initiate a sensor or a series of sensors to assess the number of participants associated with the vehicle. The assessment may be conducted at an entry point of a water amusement ride.

In certain embodiments, personal identifiers may be used in combination with a recording device. The recording device may be positioned in a water amusement park. One or more recording devices may be used throughout the water amusement park. The participant identifier may be used to activate the recording device. The participant identifier may be used to remotely activate the recording device. The recording device may include a sensor as described herein. The identifier may automatically activate the recording device upon detection by the sensor coupled to the recording device. The participant may activate the recording device by activating the personal identifier using participant input (e.g., a mechanical button, a touch screen). The participant identifier may activate one or more recording devices at one or more different times and/or timing sequences. For example several recording devices may be positioned along a length of a downhill slide. A participant wearing a personal identifier may activate (automatically or upon activation with user input) a first recording device positioned adjacent an entry point of the slide. Activating the first recording device may then activate one or more additional recording devices located along the length of the downhill water slide. Recording devices may be activated in a particular sequence so as to record the participant progress through the water slide.

In some embodiments, a recording device may record images and/or sound. The recording device may record other data associated with recorded images and/or sound. Other data may include time, date, and/or information associated with a participant wearing a participant identifier. The recording device may record still images and/or moving (i.e., short movie clips). Examples of recording devices include, but are not limited to, cameras and video recorders.

In some embodiments, a recording device may be based on digital technology. The recording device may record digital images and/or sound. Digital recording may facilitate storage of recorded events, allowing recorded events to be stored on magnetic media (e.g., hard drives, floppy disks, etc. . . . ). Digital recordings may be easier to transfer as well. Digital recordings may be transferred electronically from the recording device to a control system and/or processing device. Digital recordings may be transferred to the control system via a hard-wired connection and/or a wireless connection.

Upon recording an event, the recording device may transfer the digital recording to the control system. The participant may purchase a copy of the recording as a souvenir. The participant may purchase a copy while still in a water amusement park, upon exiting the water amusement park, and/or at a later date. The control system may print a hard copy of the digital recording. The control system may transfer an electronic copy of the recorded event to some other type of media that may be purchased by the participant to take home with them. The control system may be connected to the Internet. Connecting the control system to the Internet may allow a participant to purchase a recorded event through the Internet at a later time. A participant may be able to download the recorded event at home upon arranging for payment.

In some embodiments, personal identifiers may be used in combination with sensors to locate a position of a participant in a water amusement park. Sensors may be positioned throughout the water park. The sensors may be connected to a control system. Locations of sensors throughout the water park may be programmed into the control system. The participant identifier may activate one of the sensors automatically when it comes within a certain proximity of the sensor. The sensor may transfer data concerning the participant (e.g., time, location, and/or identity) to the control system.

In some embodiments, participant identifiers may be used to assist a participant to locate a second participant. For example, identifiers may assist a parent or guardian to locate a lost child. The participant may consult an information kiosk or automated interactive information display. The interactive display may allow the participant to enter a code, name, and/or other predetermined designation for the second participant. The interactive display may then display the location of the second participant to the participant. The location of the second participant may be displayed, for example, as an icon on a map of the park. Security measures may be taken to ensure only authorized personnel are allowed access to the location of participants. For example, only authorized personnel (e.g., water park staff) may be allowed access to interactive displays and/or any system allowing access to identity and/or location data for a participant. Interactive displays may only allow participants from a predetermined group access to participant data from their own group.

In some embodiments, participant identifiers may be used to assist in regulating throughput of participants through portions of a water amusement park. Participant identifiers may be used in combination with sensors to track a number of participants through a portion of the water amusement park. Keeping track of numbers of participants throughout the water park may allow adjustments to be made to portions of the water park. Adjustments made to portions of the water park may allow the portions to run more efficiently. Adjustments may be at least partially automated and carried out by a central control system. Increasing efficiency in portions of the water park may decrease waiting times for rides.

In some embodiments, sensors may be positioned along one or both sides of a floating queue line. Sensors in floating queue lines may be able to assist in detecting participants wearing participant identifiers. Data including about participants in the floating queue lines may be transferred to a control system. Data may include number of participants, identity of the participants, and/or speed of the participants through the floating queue lines. Based on data collected from the sensors, a control system may try to impede or accelerate the speed and/or throughput of participants through the floating queue line as described herein. Adjustment of the throughput of participants through the floating queue lines may be fully or partially automated. As numbers of participants in a particular ride increase throughput may decrease. In response to data from sensors the control system may increase the flow rate of participants to compensate. The control system may automatically notify water park staff if the control system is not able to compensate for increased flow rate of participants.

Figure 18:
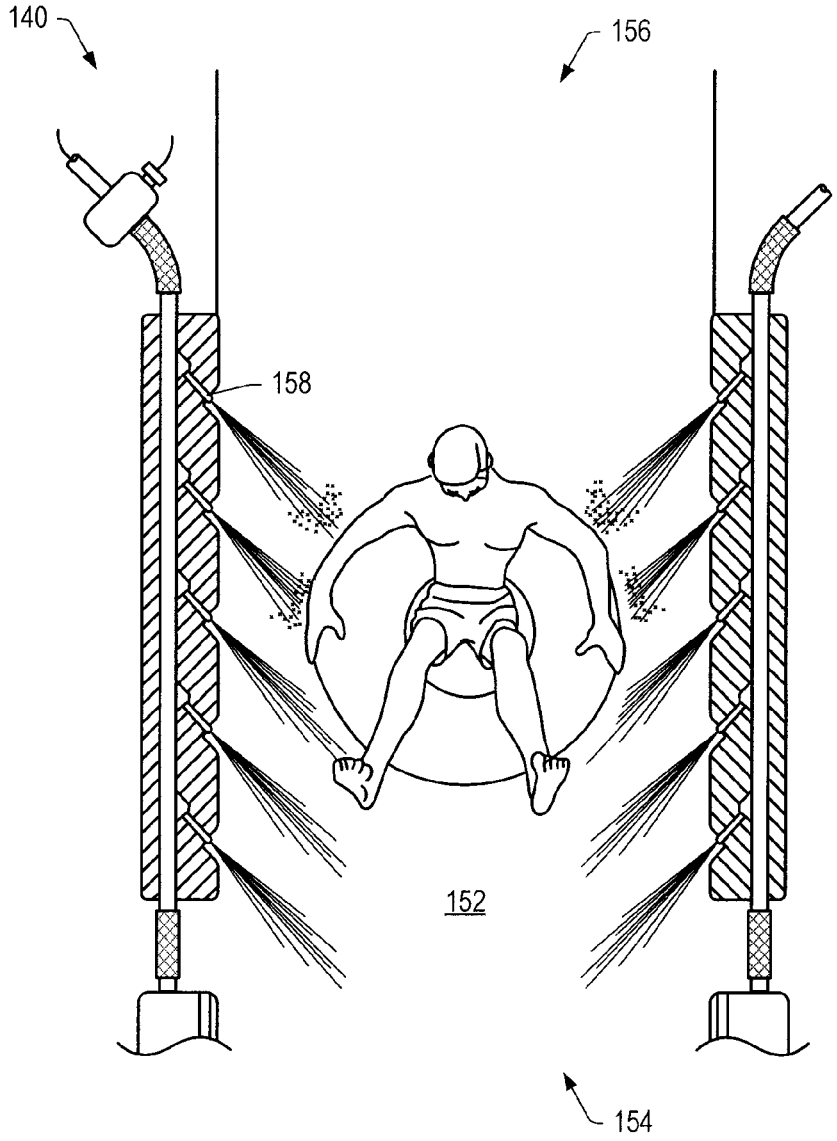
FIG. 18 depicts an embodiment of a floating queue line with jets.

In certain embodiments (an example of which is depicted in FIG. 18), floating queue system 140 includes a queue channel 152 coupled to a water ride at a discharge end 154 and coupled to a transportation channel on the input end 156. The channel 152 contains enough water to allow riders to float in the channel 152. The channel 152 additionally comprises high velocity low volume jets 158 located along the length of the channel 152. The jets are coupled to a source of pressurized water (not shown). Riders enter the input end 156 of the queue channel 152 from the coupled transportation channel, and the jets 158 are operated intermittently to propel the rider along the channel at a desired rate to the discharge end 154. This rate may be chosen to match the minimum safe entry interval into the ride, or to prevent buildup of riders in the queue channel 152. The riders are then transferred from the queue channel 152 to the water ride, either by a sheet flow lift station or by a conveyor system (described previously) without the need for the riders to leave the water and/or walk to the ride. Alternatively, propulsion of the riders along the channel 152 may be by the same method as with horizontal hydraulic head channels; that is, by introducing water into the input end 156 of the channel 152 and removing water from the discharge end 154 of the channel 152 to create a hydraulic gradient in the channel 152 that the riders float down. In this case, the introduction and removal of water from the channel 152 may also be intermittent, depending on the desired rider speed.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A floating marine life and water amusement system, comprising:

two or more floating containers configured to float in a first fluid, wherein two or more of the floating containers are coupled to one another, wherein one or more of the floating containers is configured to contain marine life, and one or more of the floating containers is configured to contain a second fluid and one or more participants in water amusement activities using the second fluid, and wherein two or more of the floating containers are coupled to one another with a water amusement ride such that the water amusement ride conveys at least one participants between two or more of the floating containers; and a view window configured to allow participants below a surface of the second fluid in a first floating container to view marine life or participants in a second floating container.

2. The system of claim 1, wherein the view window is configured to allow fluid transfer between the first floating container and the second floating container, and wherein the view window is configured to inhibit marine life and/or participants from moving between the first floating container and the second floating container.

3. The system of claim 1, wherein the view window is configured to inhibit fluid transfer between the first floating container and the second floating container, and wherein the view window is configured to inhibit marine life and/or participants from moving between the first floating container and the second floating container.

4. The system of claim 1, wherein one or more portions of one or more of the floating containers is substantially transparent and wherein one or more of the floating containers comprising a substantially transparent portion floats above a bottom surface of a first body of the first fluid such that participants may view marine life within the first body of the first fluid.

5. The system of claim 1, wherein one or more of the floating containers allow marine life and one or more participants to interact in a controlled environment.

6. The system of claim 1, wherein one or more of the floating containers allow one or more participants to observe marine life in a controlled environment.

7. The system of claim 1, wherein two or more floating containers are coupled by a system configured to transport participants from a first floating container to a second floating container.

8. The system of claim 1, wherein the first fluid comprises fresh water.

9. The system of claim 1, wherein the first fluid comprises salt water.

10. The system of claim 1, wherein one or more of the floating containers is configured to contain fresh water.

11. The system of claim 1, wherein the first fluid functions as a heat sink.

12. The system of claim 1, wherein one or more of the floating containers comprise one or more floatation devices coupled to the floating containers.

13. The system of claim 1, wherein one or more of the floating containers comprise one or more positionable floatation devices coupled to the floating containers, and wherein the position of the positionable floatation devices relative to the floating containers determines the position of the floating containers relative to a surface of the first fluid.

14. The system of claim 1, wherein one or more of the floating containers comprise one or more positionable floatation devices coupled to the floating containers, wherein the position of the positionable floatation devices relative to the floating containers determines the position of the floating containers relative to a surface of the first fluid, and wherein the positionable floatation devices are adjusted such that a majority of one or more of the floating containers extends above the surface of the first fluid.

15. The system of claim 1, wherein at least one of the water amusement activities comprises a water slide.

16. The system of claim 1, wherein at least one of the water amusement activities comprises an elevation system configured to transport one or more participants from a lower elevation to a higher elevation.

17. The system of claim 1, further comprising a waterbreak configured to dissipate at least a portion of the energy contained within an incoming wave.

18. The system of claim 1, further comprising one or more anchor devices configured to couple at least one of the floating containers to the ground.

19. A method, comprising:

floating two or more containers in a first fluid, wherein two or more of the floating containers are coupled to one another;

containing marine life in one or more of the floating containers;

containing a second fluid and one or more participants in water amusement activities using the second fluid in one or more of the floating containers;

conveying at least one participant between two or more of the floating containers with a water amusement ride; and allowing participants below a surface of the second fluid in a first floating container to view marine life and/or participants in a second floating container using a view window.

* * * * *